US009541859B2

(12) United States Patent
Jeong et al.

(10) Patent No.: US 9,541,859 B2
(45) **Date of Patent: *Jan. 10, 2017**

(54) ELECTROPHOTOGRAPHIC IMAGE FORMING APPARATUS, TONER CARTRIDGE FOR THE SAME, IMAGING CARTRIDGE FOR THE SAME, AND METHOD OF CONTROLLING TONER LEVEL IN DEVELOPING CHAMBER OF THE SAME

(71) Applicant: SAMSUNG ELECTRONICS CO., LTD., Suwon-si, Gyeonggi-do (KR)

(72) Inventors: Seong-ho Jeong, Seoul (KR); Sang-jin Park, Hwaseong-si (KR); Byeong-no Jeong, Suwon-si (KR); Jong-won Han, Incheon (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

This patent is subject to a terminal disclaimer.

(21) Appl. No.: 15/017,126

(22) Filed: Feb. 5, 2016

(65) Prior Publication Data

US 2016/0154338 A1 Jun. 2, 2016

Related U.S. Application Data

(62) Division of application No. 14/579,025, filed on Dec. 22, 2014, now Pat. No. 9,285,705.

(30) Foreign Application Priority Data

Jun. 9, 2014 (KR) ..... 10-2014-0069571

(51) Int. Cl.
*G03G 21/16* (2006.01)
*G03G 15/08* (2006.01)

(52) U.S. Cl.
CPC ..... *G03G 15/0831* (2013.01); *G03G 15/0834* (2013.01); *G03G 15/0862* (2013.01);
(Continued)

(58) Field of Classification Search
CPC ..... G03G 15/0831; G03G 15/0834; G03G 15/0856; G03G 15/0862; G03G 15/0868; G03G 2215/0888; G03G 2215/0891; G03G 2215/0894; G03G 2215/0897
(Continued)

(56) References Cited

U.S. PATENT DOCUMENTS 7,978,997 B2 7/2011 Tokuda
8,073,355 B2 12/2011 Lee et al.
(Continued)

FOREIGN PATENT DOCUMENTS

EP 2 363 754 9/2011
JP 2002-229244 8/2002
(Continued)

OTHER PUBLICATIONS

European Search Report dated Oct. 21, 2015 from European Patent Application No. 15154786.5, 5 pages.
(Continued)

*Primary Examiner* — Benjamin Schmitt
(74) *Attorney, Agent, or Firm* — Staas & Halsey LLP

(57) ABSTRACT

An electrophotographic image forming apparatus may include an imaging cartridge and a toner cartridge that are detachably attached to a main body, a first optical sensor that is mounted in the imaging cartridge and detects a toner level in a development chamber, and a second optical sensor that is mounted in the toner cartridge and detects a toner level in the development chamber.

10 Claims, 24 Drawing Sheets

(52) U.S. Cl.
CPC ..... *G03G 15/0868* (2013.01); *G03G 21/1642* (2013.01); *G03G 2215/0891* (2013.01); *G03G 2215/0894* (2013.01)

(58) Field of Classification Search
USPC ..... 399/27, 61, 111, 119, 262
See application file for complete search history.

(56) References Cited

U.S. PATENT DOCUMENTS

| | | | | |
|---|---|---|---|---|
| 8,861,991 | B2 | 10/2014 | Kubota et al. | |
| 2002/0085847 | A1* | 7/2002 | Yoshida | G03G 15/55 399/12 |
| 2004/0101322 | A1 | 5/2004 | Tsukida et al. | |
| 2005/0117919 | A1 | 6/2005 | Ito et al. | |
| 2005/0117920 | A1 | 6/2005 | Ogata et al. | |
| 2005/0129417 | A1 | 6/2005 | Asakura | |
| 2010/0166441 | A1* | 7/2010 | Kobayashi | G03G 21/12 399/35 |
| 2012/0189327 | A1 | 7/2012 | Kubota et al. | |

FOREIGN PATENT DOCUMENTS

| | | | | |
|---|---|---|---|---|
| JP | 2004061596 | A * | 2/2004 | G03G 21/18 |
| JP | 2007-79284 | | 3/2007 | |
| JP | 2009-276417 | | 11/2009 | |
| JP | 2012-128362 | | 7/2012 | |
| JP | 2012-155141 | | 8/2012 | |
| JP | 2012-252090 | | 12/2012 | |
| KR | 10-2009-0090913 | | 8/2009 | |

OTHER PUBLICATIONS

European Office Action dated Nov. 11, 2015 from European Patent Application No. 15154786.6, 8 pages.
Korean Office Action dated Jun. 9, 2015 from Korean Patent Application No. 10-2014-0069571, 8 pages.
Partial European Search Report dated Jul. 1, 2015 from European Patent Application No. 15154786.6, 6 pages.
International Search Report and Written Opinion dated Feb. 26, 2015 from International Patent Application No. PCT/KR2015/000547, 9 pages.
U.S. Restriction Requirement dated May 20, 2015 from U.S. Appl. No. 14/579,025.
U.S. Office Action dated Jul. 27, 2015 from U.S. Appl. No. 14/579,025.
U.S. Notice of Allowance dated Nov. 6, 2015 from U.S. Appl. No. 14/579,025.
U.S. Corrected Notice of Allowability dated Feb. 2, 2016 from U.S. Appl. No. 14/579,025.
U.S. Appl. No. 14/579,025, filed Dec. 22, 2014, Seong-ho Jeong, Samsung Electronics Co., Ltd.

* cited by examiner

ELECTROPHOTOGRAPHIC IMAGE FORMING APPARATUS, TONER CARTRIDGE FOR THE SAME, IMAGING CARTRIDGE FOR THE SAME, AND METHOD OF CONTROLLING TONER LEVEL IN DEVELOPING CHAMBER OF THE SAME

CROSS-REFERENCE TO RELATED APPLICATIONS

This application is a divisional application of U.S. patent application Ser. No. 14/579,025, filed on Dec. 22, 2014, which is currently pending and claims the priority benefit of Korean Patent Application No. 10-2014-0069571, filed on Jun. 9, 2014 in the Korean Intellectual Property Office, the disclosures of each of which are incorporated herein in their entirety by reference.

BACKGROUND

1. Field

One or more embodiments of the disclosure relate to an electrophotographic image forming apparatus, a toner cartridge for the same, an imaging cartridge for the same, and a method of adjusting a toner level in the same.

2. Description of the Related Art

An image forming apparatus using electrophotography prints an image on a recording medium by supplying toner to an electrostatic latent image formed on a photoreceptor to form a visible toner image on the photoreceptor, transferring the visible toner image onto the recording medium, and fusing the transferred visible toner image on the recording medium.

A process cartridge generally refers to an assembly of components for forming a visible toner image. The process cartridge may be a consumable product that is detachable from a main body of an image forming apparatus and replaceable after the lifespan thereof has ended. A process cartridge may have various structures such as a structure in which a photoreceptor, a development roller that supplies toner to the photoreceptor, and a container portion containing toner are integrally formed, a structure divided into an image cartridge including a photoreceptor and a development roller and a toner cartridge containing toner, or a structure divided into a photoreceptor cartridge including a photoreceptor, a development cartridge including a development roller, and a toner cartridge containing toner.

Toner is supplied from a toner containing unit to a development chamber, and is attached on a photoreceptor by using a development roller mounted in the development chamber. When too much toner is supplied to the development chamber, a toner stress is also increased due to a pressure of the toner in the development chamber, and this may degrade properties of the toner. Thus, an appropriate toner level in the development chamber has to be maintained.

SUMMARY

One or more embodiments of the disclosure include an electrophotographic image forming apparatus in which a stable toner level may be maintained, a toner cartridge, an imaging cartridge, and a method of adjusting a toner level.

Additional aspects will be set forth in part in the description which follows and, in part, will be apparent from the description, or may be learned by practice of the disclosed embodiments.

According to one or more embodiments of the disclosure, an electrophotographic image forming apparatus may include: a main body, an imaging cartridge including a photoreceptor on which an electrostatic latent image is formed, a development chamber, and a development roller that supplies toner from the development chamber to the photoreceptor to develop the electrostatic latent image. The image cartridge may be attached to or detached from the main body. The electrophotographic image forming apparatus may further include a toner cartridge that contains toner to be supplied to the development chamber and may be detachably attached to and from the main body, a first optical sensor that is mounted in the imaging cartridge to detect a toner level in the development chamber, and a second optical sensor that is mounted in the toner cartridge to detect a toner level in the development chamber.

The first and second optical sensors may be arranged in an axial direction of the development roller.

The first and second optical sensors may be disposed outside the development chamber, and the first and second optical sensors may each include a light emitting unit (light emitter) that irradiates light into the development chamber and a light receiving unit (light receiver) that receives light that has passed through the development chamber.

The electrophotographic image forming apparatus may further include a light guide member that is disposed in the development chamber and guides light emitted from the light emitting unit to pass through the development chamber and reach the light receiving unit.

The light guide member may include a first light guide member that guides light irradiated from the light emitting unit into the development chamber and a second light guide member that guides the light that has passed through the development chamber to the light receiving unit, and the first and second light guide members may include a light exit surface and a light incident surface that face each other, respectively, and a wiper that wipes the light exit surface and the light incident surface may be disposed in the development chamber.

An agitation member that stirs toner may be disposed in the development chamber, and the wiper may be mounted on a rotational shaft of the agitation member so as to wipe the light exit surface and the light incident surface.

Overlapping amounts between the wiper and the light exit surface and the light incident surface may be from about 0.2 mm to about 0.4 mm.

The electrophotographic image forming apparatus may further include a supply roller that supplies toner from the development chamber to the development roller, and a reference position of light that passes through the development chamber may be between a horizontal line that is away by about 0 mm to about 2 mm from a vertex of an outer circumferential surface of the supply roller in a gravitational direction and a horizontal line that passes through a center of the supply roller.

A first memory unit (first memory) that may include a first contact portion via which the first memory unit is connected to the main body to transmit information of the toner cartridge to the main body may be mounted in the toner cartridge, and a second memory unit (second memory) that may include a second contact portion via which the second memory unit is connected to the main body to transmit information of the imaging cartridge to the main body may be mounted in the imaging cartridge, and the first and second optical sensors may transmit detection signals to the main body via the first and second contact portions.

The main body may determine that the imaging cartridge and the toner cartridge are mounted in the main body when the detection signals of the first and second optical sensors are transmitted to the main body.

The toner cartridge may include a toner supply member that supplies toner to the development chamber, and the main body may include: a driving unit (driver) that drives the toner supply member, and a controller that controls an operation of the image forming apparatus, and the controller may control the first and second optical sensors to measure a toner level a plurality of number of times, set averages of respective measurement values as a first toner level and a second toner levels measured by the first and second optical sensors, and control the driving unit such that the toner level of the development chamber is adjusted based on the first and second toner levels.

The first and second optical sensors may be disposed outside the development chamber, and each of the first and second optical sensors may include a light emitting unit that irradiates light into the development chamber and a light receiving unit that receives light that has passed through the development chamber, and a first light guide member that guides light irradiated from the light emitting unit into the development chamber and may include a light exit surface, a second light guide member that guides the light that has passed through the development chamber to the light receiving unit and may include a light incident surface facing the light exit surface, and a wiper that wipes the light incident surface and the light exit surface may be disposed in the development chamber, and when a driving period of the wiper is one measurement period, the controller may control the first and second optical sensors to measure the toner level several times during the one measurement period and for at least m measurement periods (where m is an integer that is equal to or greater than 2).

The controller may control the driving unit such that toner is supplied to the development chamber when at least one of the first and second toner levels is smaller than a first reference toner level, and toner supply to the development chamber may be stopped when at least one of the first and second toner levels is greater than the first reference toner level.

The controller may determine that a detection error occurred in a corresponding optical sensor when a state where at least one of a difference between a maximum and a minimum of each of the first and second toner levels is smaller than a second reference toner level is maintained for n measurement periods. For example, n may be greater than m. When the detection error occurred, the controller may ignore the toner level detected by using the corresponding optical sensor and adjust the toner level based on toner levels of the remaining optical sensor.

The controller may determine that a supply error occurred when at least one of the first and second toner level does not increase to a third reference toner level or higher. The third reference toner level may be smaller than the first reference toner level. When the controller determined that the supply error occurred, the controller may output different messages according to a residual toner amount of the toner cartridge.

According to one or more embodiments of the disclosure, a toner cartridge that is detachably attached to or detached from a main body of an image forming apparatus, may include: a toner containing unit (toner container) containing toner to be supplied to a development chamber in the main body, an optical sensor comprising a light emitting unit that irradiates light into the development chamber through a first light window provided in the development chamber and a light receiving unit that receives light that is emitted through a second light window provided in the development chamber after passing through the development chamber, and detecting a toner level in the development chamber, and a memory unit (memory) that is connected to a connection portion provided in the main body when the toner cartridge is mounted in the main body to transmit to the main body the toner level detected by using the optical sensor.

The memory unit may include a contact portion via which the memory unit is connected to the main body, wherein the contact portion is movable to a first position inside the toner cartridge and a second position outside the toner cartridge so that the contact portion is connected to the connection portion.

The toner cartridge may further include a protection member that is moved as the contact portion is moved to the first or second position to a retreat position in the cartridge and a protruding position outside the cartridge in order to be inserted into an insertion portion in the main body.

The protection member may be inserted into the insertion portion before the contact portion is connected to the connection portion to align the contact portion and the connection portion.

The toner cartridge may further include a moving member on which the contact portion is mounted, wherein the moving member is moved to the first or second position, and the protection member may be integrally formed with the moving member.

The toner cartridge may further include a waste toner containing unit (waste toner container) containing waste toner removed from the photoreceptor provided in the main body, and wherein the waste toner containing unit may be disposed below the toner containing unit in a gravitational direction.

The toner cartridge may further include a toner discharging unit (toner discharger) comprising a toner outlet at one end of the toner discharging unit, and wherein a first toner supply member that carries toner to the toner discharging unit may be disposed in the toner containing unit.

A second toner supply member that carries toner to the toner discharging unit may be disposed in the toner discharging unit.

According to one or more embodiments of the disclosure, an imaging cartridge that is detachably attached to a main body of an image forming apparatus, may include: a photoreceptor on which an electrostatic latent image is formed, a development chamber, a development roller that supplies toner from the development chamber to the photoreceptor; a first toner level detecting unit (first toner level detector) that is disposed at a first end portion of the development chamber in an axial direction of the development roller and detects a toner level in the development chamber, and a second toner level detecting unit (second toner level detector) that is disposed at a second end portion of the development chamber in the axial direction of the development roller and detects a toner level in the development chamber.

According to one or more embodiments of the disclosure, a method of adjusting a toner level in a development chamber of an electrophotographic image forming apparatus, may include: obtaining first and second toner levels at first and second end portions of the development chamber, respectively, in an axial direction of the development roller by respectively using first and second toner level detecting units of an optical detection method, and supplying toner to the development chamber when at least one of the first and second toner levels is smaller than a first reference toner level, and stopping toner supply to the development chamber when at least one of the first and second toner levels is greater than the first reference toner level.

The first and second toner levels may be respectively an average of multiple measurements. When a driving period of a wiper that wipes a light incident surface and a light exit surface disposed in the development chamber of the first and second toner level detecting units is one measurement period, the first and second toner levels may be respectively an average of measurements measured at least twice during the one measurement period and for m measurement periods (where m is an integer equal to or greater than 2).

The method may further include when a state where at least one of a difference between a maximum and a minimum of each of the first and second toner levels is smaller than a second reference toner level is maintained for n measurement periods, determining that a detection error occurred in a corresponding toner level detecting unit. The method may further include, when it is determined that the detection error occurred, ignoring the toner level of the corresponding toner level detecting unit and adjusting a toner level based on toner levels of the remaining toner level detecting units. For example, n may be greater than m.

The method may further include, when at least one of the first and second toner levels does not increase to a third reference toner level or higher, determining that a toner supply error occurred. The method may further include, when it is determined that the toner supply error occurred, outputting different messages according to a residual toner amount in a toner cartridge. The third reference toner level may be smaller than the first reference toner level.

The first and second toner level detecting units may each include an optical sensor that irradiates light to the development chamber and receives light that has passed through the development chamber, and the first toner level detecting unit may be mounted in an imaging cartridge including the development chamber, and the optical sensor of the second toner level detecting unit may be mounted in a toner cartridge containing toner to be supplied to the development chamber.

The imaging cartridge and the toner cartridge may be individually replaceable.

According to one or more embodiments of the disclosure, an image forming apparatus may include a main body, an imaging cartridge, a toner cartridge, a first toner level detector mounted in one of the imaging cartridge and the toner cartridge to detect a toner level in a development chamber of the imaging cartridge, and at least a portion of a second toner level detector mounted in one of the imaging cartridge and the toner cartridge to detect another toner level in the development chamber.

The first toner level detector may be mounted in the imaging cartridge and may include at least one optical sensor, and the whole or entire second toner level detector may be mounted in the imaging cartridge and may include at least one optical sensor. The first toner level detector and second toner level detector may be disposed at opposite ends of the development chamber along a lengthwise direction of the development chamber.

The first toner level detector and the second toner level detector may each include at least one optical sensor. The first toner level detector may be mounted in the imaging cartridge, and may be disposed at one end of the development chamber along a lengthwise direction of the development chamber. A portion of the second toner level detector may be mounted in the toner cartridge, at a position corresponding to the other end of the development chamber along a lengthwise direction of the development chamber, and a remaining portion of the second toner level detector may be mounted in the imaging cartridge, and may be disposed at the other end of the development chamber along a lengthwise direction of the development chamber, at a position which corresponds to the portion of the second toner level detector mounted in the toner cartridge.

The portion of the second toner level detector mounted in the toner cartridge may include the at least one optical sensor, and the remaining portion of the second toner level detector mounted in the imaging cartridge may include first and second light guide members. Light emitted by the at least one optical sensor may pass through a first light window of the imaging cartridge into the development chamber, and light may be received by the at least one optical sensor through a second light window of the imaging cartridge after passing through the development chamber, via the first and second light guide members.

BRIEF DESCRIPTION OF THE DRAWINGS

These and/or other aspects will become apparent and more readily appreciated from the following description of the embodiments, taken in conjunction with the accompanying drawings in which.

DETAILED DESCRIPTION

Figure 1:
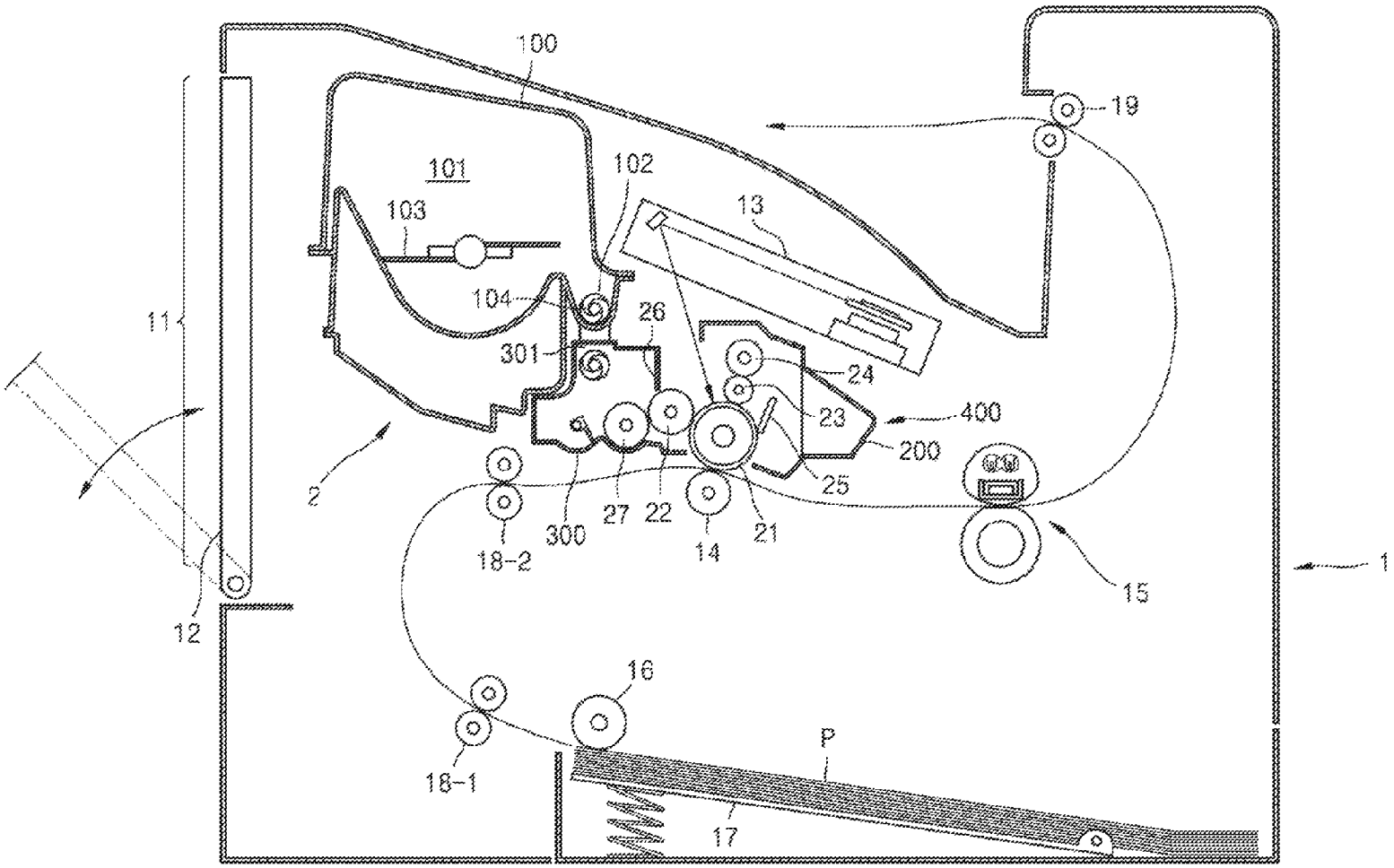
FIG. 1 is a schematic structural diagram of an electrophotographic image forming apparatus according to an embodiment of the disclosure.

Reference will now be made in detail to embodiments, examples of which are illustrated in the accompanying drawings, wherein like reference numerals refer to like elements throughout. In the specification and the drawings, elements having substantially the same functions and structures will be labeled the same reference numerals to omit repeated description. In this regard, the embodiments may have different forms and should not be construed as being limited to the descriptions set forth herein. Accordingly, the embodiments are merely described below, by referring to the figures, to explain aspects of the disclosure. Expressions such as "at least one of," when preceding a list of elements, modify the entire list of elements and do not modify the individual elements of the list.

FIG. 1 is a schematic structural diagram of an electrophotographic image forming apparatus according to an embodiment of the disclosure.

Referring to FIG. 1, a main body 1 of the image forming apparatus and a process cartridge 2 are shown. The main body 1 may include an opening 11 providing a passage for the process cartridge 2 to be mounted in or removed from the main body 1. A cover 12 closes or opens the opening 11. The main body 1 may include an exposure unit 13, a transfer roller 14, and a fusing unit 15. Also, the main body 1 may include a recording medium transfer structure for loading and transferring a recording medium P where an image is to be formed.

The process cartridge 2 may include a toner containing unit 101, a photoconductive drum 21, on a surface of which an electrostatic latent image is formed, and a development roller 22 that receives toner from the toner containing unit 101 to supply the toner to the electrostatic latent image so as to develop the electrostatic latent image into a visible toner image.

The process cartridge 2 may have a first structure divided into an imaging cartridge 400 including the photoconductive drum 21 and the development roller 22 and a toner cartridge 100 including the toner containing unit 101, a second structure divided into a photoreceptor cartridge 200 including the photoconductive drum 21, a development cartridge 300 including the development roller 22, and a toner cartridge 100 including the toner containing unit 101, a third structure divided into a photoreceptor cartridge 200 and a development cartridge 300 including the toner containing unit 101, and/or a fourth structure in which a photoreceptor cartridge 200, a development cartridge 300, and a toner cartridge 100 are integrally formed with one another.

In the process cartridge 2 having the first structure (or the second structure), when the toner cartridge 100 is mounted in the main body 1, the toner cartridge 100 may be connected to the imaging cartridge 400 (or the development cartridge 300). For example, when the toner cartridge 100 is mounted in the main body 1, a toner discharging unit 102 of the toner cartridge 100 and a toner inlet portion 301 of the imaging cartridge 400 (or the development cartridge 300) may be connected to each other.

Figure 2:
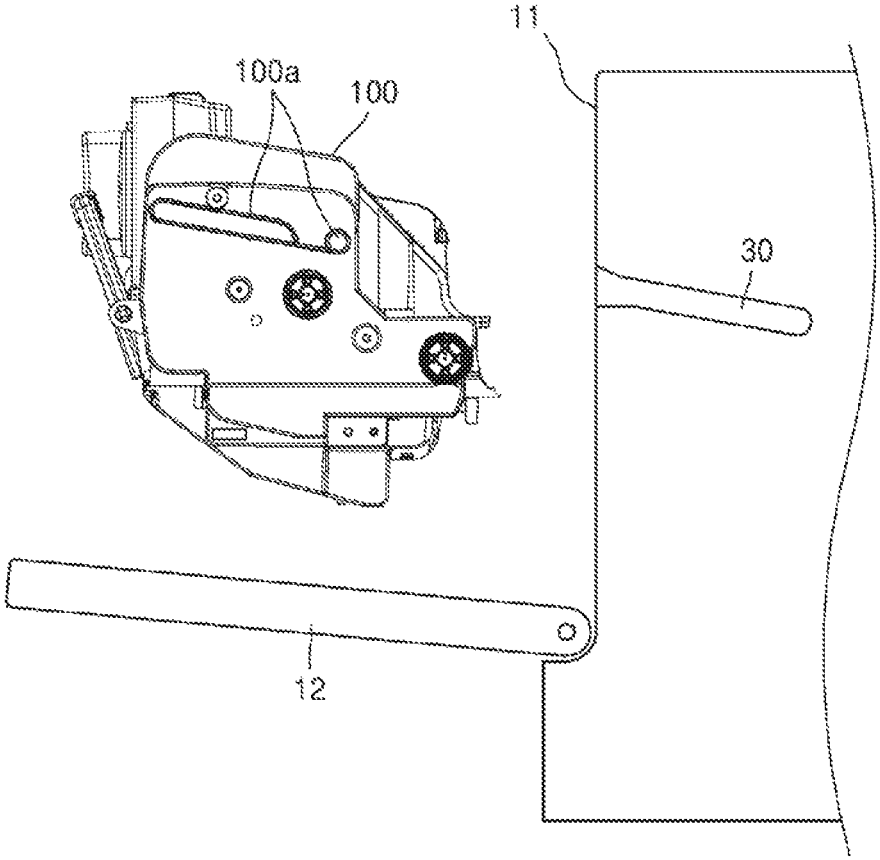
FIG. 2 illustrates replacement of a toner cartridge.

For example, the process cartridge 2 according to an embodiment of the disclosure may have the first structure. The imaging cartridge 400 and the toner cartridge 100 may be individually attached to or detached from the main body 1. The process cartridge 2 may be a consumable product that is replaced after its lifespan expires. In general, the lifespan of the imaging cartridge 400 is longer than the lifespan of the toner cartridge 100. When toner contained in the toner cartridge 100 is completely consumed, just the toner cartridge 100 may be individually replaced as illustrated in FIG. 2, and thus, costs for replacement of consumables may be reduced. Referring to FIG. 2, for example, a guide protrusion 100*a* may be formed on a side portion of the toner cartridge 100, and a guide rail 30 that guides the guide protrusion 100*a* may be provided in the main body 1. The toner cartridge 100 may be guided via the guide rail 30 to be attached to or detached from the main body 1. While not shown in the drawing, a guide unit that guides the imaging cartridge 400 may be provided in the main body 1.

The photoreceptor cartridge 200 may include a photoconductive drum 21. The photoconductive drum 21 is an example of a photoreceptor, an electrostatic latent image being formed on a surface thereof, and may include a conductive metal pipe and a photosensitive layer around the conductive metal pipe. A charging roller 23 is an example of a charger for charging the photoconductive drum 21 to have a uniform surface potential. A charging brush or a corona charger may be used instead of the charging roller 23. A cleaning roller 24 may also be provided in the image forming apparatus for removing foreign materials on a surface of the charging roller 23. A cleaning blade 25 is an example of a cleaning unit for removing toner and foreign materials on a surface of the photoconductive drum 21 after a transfer process which will be described later. A cleaning apparatus having another shape, such as a rotating brush, may be used instead of the cleaning blade 25.

The development cartridge 300 receives toner from the toner cartridge 100 and supplies the toner to the electrostatic latent image formed on the photoconductive drum 21 so that the electrostatic latent image formed on the photoconductive drum 21 is developed into the visible toner image.

Figure 3A:
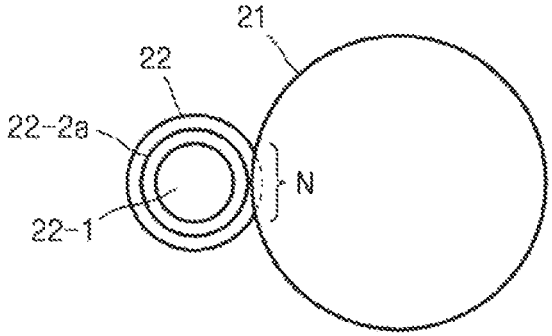
FIG. 3A is a diagram of an arrangement of a photoconductive drum and a development roller according to a contact development method.
Figure 3B:
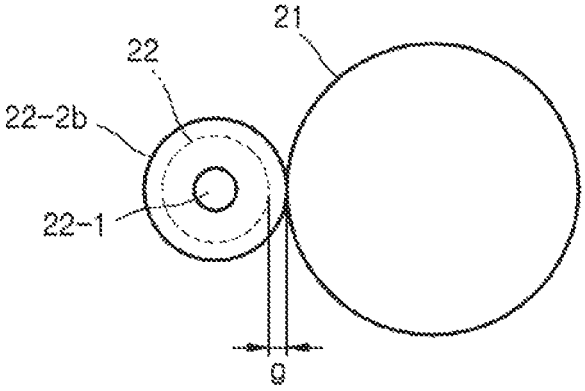
FIG. 3B is a diagram of an arrangement of a photoconductive drum and a development roller according to a non-contact development method.

Examples of a development method include a one-component development method in which toner is used and a two-component development method in which toner and a carrier are used. The development cartridge 300 according to an embodiment uses a one-component development method. The development roller 22 may be used to supply toner to the photosensitive drum 21. A development bias voltage to supply toner to the photosensitive drum 21 may be applied to the development roller 22. The one-component development method may be classified into a contact development method, wherein the development roller 22 and the photoconductive drum 21 are rotated while contacting each other, and a non-contact development method, wherein the development roller 22 and the photoconductive drum 21 are rotated by being spaced apart from each other by dozens to hundreds of microns. FIG. 3A is a diagram of an arrangement of the photoconductive drum 21 and the development roller 22 in the contact development method, and FIG. 3B is a diagram of an arrangement of the photoconductive drum 21 and the development roller 22 in the non-contact development method. Referring to FIG. 3A, in the contact development method, a gap maintaining member 22-2*a* having a smaller diameter than the development roller 22 may be provided on each of both ends of a rotation shaft 22-1 of the development roller 22. A contact amount of the development roller 22 to the photoconductive drum 21 may be constrained by the gap maintaining member 22-2*a* which contacts the surface of the photoconductive drum 21. A development nip N is formed as the development roller 22 contacts the photoconductive drum 21. Referring to FIG. 3B, in the non-contact development method, a gap maintaining member 22-2*b* having a larger diameter than the development roller 22 may be provided on each of the both ends of the rotation shaft 22-1 of the development roller 22. A development gap g between the development roller 22 and the photoconductive drum 21 may be constrained by the gap maintaining member 22-2*b* which contacts the surface of the photoconductive drum 21. To maintain the development gap g and the development nip N, it is sufficient that the gap maintaining members 22-2*a* and 22-2*b* contact an object, and the gap maintaining members 22-2*a* and 22-2*b* do not necessarily have to contact the surface of the photoconductive drum 21.

A regulator 26 may regulate an amount of toner supplied from the development roller 22 to a development region where the photoconductive drum 21 and the development roller 22 face each other. The regulator 26 may be a doctor blade elastically contacting a surface of the development roller 22. A supply roller 27 may supply toner in the process cartridge 2 to a surface of the development roller 22. To this end, a supply bias voltage may be applied to the supply roller 27.

When a two-component development method is used, the development roller 22 may be spaced apart from the photoconductive drum 21 by dozens to hundreds of microns. Although not illustrated in the drawings, the development roller 22 may have a structure in which a magnetic roller is disposed in a hollow cylindrical sleeve. The toner may be adhered to a surface of a magnetic carrier. The magnetic carrier may be adhered to the surface of the development roller 22 to be transferred to the development region where the photoconductive drum 21 and the development roller 22 face each other. Only the toner may be supplied to the photoconductive drum 21 according to the development bias voltage applied between the development roller 22 and the photoconductive drum 21, and thus the electrostatic latent image formed on the surface of the photoconductive drum 21 is developed into the visible toner image. The process cartridge 2 may include an agitator (not shown) for mixing and stirring the toner and a carrier and transporting the mixture to the development roller 22. The agitator may be an auger, and a plurality of the agitators may be prepared in the process cartridge 2.

The exposure unit 13 may form the electrostatic latent image on the photoconductive drum 21 by irradiating light modulated according to image information to the photoconductive drum 21. The exposure unit 13 may include one or more of a laser scanning unit (LSU) using a laser diode as a light source, or a light-emitting diode (LED) exposure unit using an LED as a light source, for example.

The transfer roller 14 is an example of a transfer unit for transferring a toner image from the photoconductive drum 21 to the recording medium P. A transfer bias voltage for transferring the toner image to the recording medium P may be applied to the transfer roller 14. A corona transfer unit or a transfer unit using a pin scorotron method may be used instead of the transfer roller 14.

The recording media P may be picked up one by one from a loading table 17 by a pickup roller 16, and may be transferred by feed rollers 18-1 and 18-2 to a region where the photoconductive drum 21 and the transfer roller 14 face each other.

The fusing unit 15 may apply heat and pressure to an image transferred to the recording medium P so as to fuse and fix the image on the recording medium P. The recording medium P that passes through the fusing unit 15 may be discharged outside the main body 1 by a discharge roller 19.

According to the above structure, the exposure unit 13 may irradiate the light modulated according to the image information to the photoconductive drum 21 to develop the electrostatic latent image. The development roller 22 may supply the toner to the electrostatic latent image to form the visible toner image on the surface of the photoconductive drum 21. The recording medium P loaded in the loading table 17 may be transferred to the region where the photoconductive drum 21 and the transfer roller 14 face each other by the pick up roller 16 and the feed rollers 18-1 and 18-2, and the toner image may be transferred on the recording medium P from the photoconductive drum 21 according to the transfer bias voltage applied to the transfer roller 14. After the recording medium P passes through the fusing unit 15, the toner image may be fused and fixed on the recording medium P according to heat and pressure. After the fusing, the recording medium P may be discharged by the discharge roller 19.

Hereinafter, the photoreceptor cartridge 200 and the development cartridge 300 that form the imaging cartridge 400 will be respectively referred to as the photoreceptor unit 200 and the developing unit 300. The photoreceptor unit 200 and the development unit 300 may be connected to each other such that the development nip N or the development gap g may be maintained.

Figure 4:
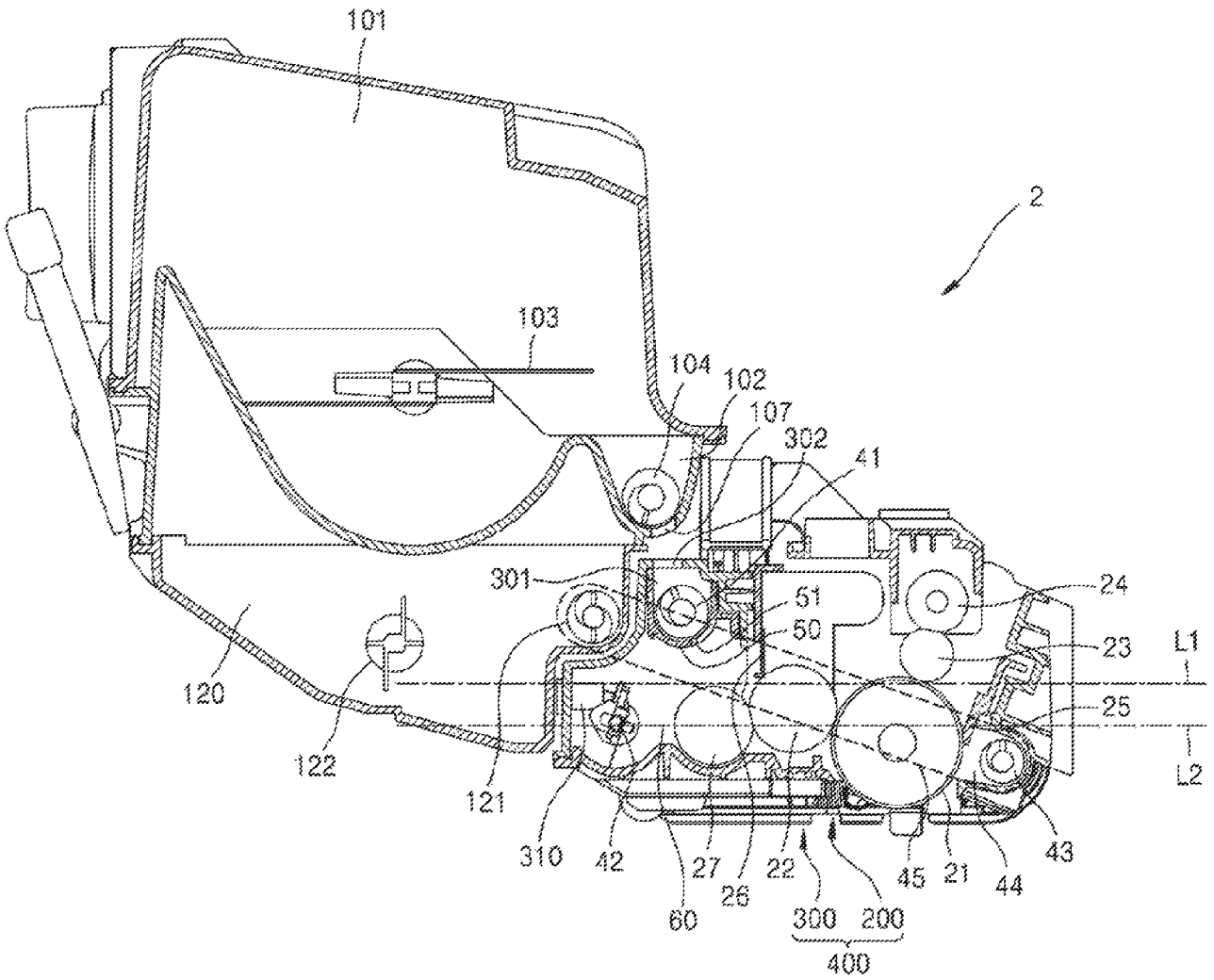
FIG. 4 is a cross-sectional view of a process cartridge according to an embodiment.

FIG. 4 is a cross-sectional view of the process cartridge 2 according to an embodiment. Referring to FIG. 4, the development unit 300 may be disposed below the toner containing unit 101 in a gravitational direction. According to this structure, toner contained in the toner containing unit 101 may be supplied to the development unit 300 by using gravity, and thus, toner may be easily supplied from the toner containing unit 101 to the development unit 300.

The toner contained in the toner containing unit 101 may be discharged from the toner cartridge 100 through a toner outlet 107 provided at the toner discharging unit 102 and may be supplied into the inner space of the development unit 300, that is, into a development chamber 60, through a toner inlet 302 provided at the toner inlet portion 301. The toner outlet 107 may be disposed at an end portion of the toner discharging unit 102 in a length direction. The toner inlet 302 may be disposed at an end portion of the toner inlet portion 301 in a length direction to face the toner outlet 107. The length direction of the toner discharging unit 102 and the toner inlet portion 301 may refer to an axial direction of the photoconductive drum 21, the supply roller 27, and the development roller 22.

A toner supply member that supplies toner contained in the toner containing unit 101 to the development chamber 60 may be disposed in the toner containing unit 101. The toner supply member may include a first toner supply member 103 that supplies toner contained in the toner containing unit 101 to the toner discharging unit 102. The toner supply member may further include a second toner supply member 104 mounted in the toner discharging unit 102. The second toner supply member 104 may transport toner in the toner discharging unit 102 to the toner outlet 107 disposed at an end of the toner discharging unit 102. The first toner supply member 103 may radially transport the toner to supply the same to the toner discharging unit 102. For example, a paddle having a rotational shaft and agitation wings that are radially extended may be used as the first toner supply member 103. The second toner supply member 104 transports the toner supplied by using the first toner supply member 103 in the length direction. For example, an auger including a rotational shaft and spiral wings may be used as the second toner supply member 104.

A first toner transporting member 41 that transports toner in the length direction may be disposed in the toner inlet portion 301. For example, an auger having a rotational shaft and spiral wings may be used as the first toner transporting member 41. A toner supply guide 50 extended in the length direction may be disposed under the first toner transporting member 41. The toner supply guide 50 may be disposed above the supply roller 27 in a gravitational direction. For example, the toner supply guide 50 may have a shape surrounding a lower portion of the first toner transporting member 41 disposed thereinside. A slit 51 may be formed in the toner supply guide 50. Toner that is transported by using the first transporting member 41 in the length direction drops into the inner space of the development unit 300 (the development chamber 60) through the slit 51. The toner may immediately drop on a surface of the supply roller 27, and a portion of the toner may drop into the development chamber 60.

A second toner transporting member 42 may be further disposed in the development unit 300. The second toner transporting member 42 may supply to the supply roller 27 again the toner that is not immediately supplied from the toner inlet 302 to the surface of the supply roller 27 and is supplied to the development chamber 60 and toner that is separated from the surface of the supply roller 27. For example, a paddle that radially transports toner may be used as the second toner transporting member 42.

Toner that remains on the surface of the photoconductive drum 21 after transferring is removed from the surface of the photoconductive drum 21 by using the cleaning blade 25. The removed waste toner may be contained in the waste toner accommodation space 44. A waste toner discharging member 43 that transports the waste toner in an axial direction is disposed in the waste toner accommodation space 44. The waste toner discharging member 43 may be, for example, an auger that may include a rotational shaft and spiral wings. The waste toner may be carried to an end portion of the waste toner accommodation space 44 in the length direction (that is, in an axial direction of the waste toner discharging member 43) by using the waste toner transporting member 43 to be discharged from the waste toner accommodation space 44.

A waste toner containing unit 120 may be provided below the toner containing unit 101 in a gravitational direction. The waste toner containing unit 120 may be connected to the waste toner accommodation space 44 via a waste toner transporting unit 45. The waste toner may be carried to the waste toner containing unit 120 by using the waste toner transporting unit 45 to be stored in the waste toner containing unit 120. Waste toner flows into the waste toner containing unit 120 through a waste toner inlet (not shown) provided at an end portion of the waste toner containing unit 120. A first waste toner transporting member 121 that carries, in an axial direction, the waste toner that has flown through the waste toner inlet (not shown) is disposed in the waste toner containing unit 120. A second waste toner transporting member 122 that radially transports the waste toner transported by using the first waste toner transporting member 121 and disperses the same into the waste toner containing unit 120 may be further disposed in the waste toner containing unit 120. For example, an auger including a rotational shaft and spiral wings may be used as the first waste toner transporting member 121. For example, a paddle having a rotational shaft and agitation wings that are externally extended with respect to the rotational shaft may be used as the second waste toner transporting member 122.

A lifetime of the toner cartridge 100 is usually shorter than that of the photoreceptor cartridge 200 or the imaging cartridge 400. As the waste toner containing unit 120 is provided in the toner cartridge 100, the waste toner containing unit 120 is also replaced when the toner cartridge 100 is replaced. Thus, the lifetime of the photoreceptor cartridge 200 or the imaging cartridge 400 may not be affected by an amount of waste toner. Consequently, the photoreceptor cartridge 200 or the imaging cartridge 400 may have a long lifetime. Also, space for containing waste toner may be removed from or minimized in the photoreceptor cartridge 200 or the imaging cartridge 400, and thus, the photoreceptor cartridge 200 or the imaging cartridge 400 may have a compact size.

To achieve a uniform image quality during the lifetime of the process cartridge 2, a degree of toner stress, which causes degradation of the properties of toner, has to be reduced. If toner remains for a long time in the development chamber 60, the toner is stirred by the second toner transporting member 42 and thus stress is applied to the toner. If too much toner exists in the development chamber 60, a toner pressure increases. The excessive toner pressure causes an increase in the degree of toner stress and an increase in a driving load of the process cartridge 2. Thus, by maintaining a toner level of the development chamber 60 at a predetermined level and supplying new toner from the toner containing unit 101 to the development chamber 60 only when the toner level drops below the predetermined level, the stress applied to the toner may be reduced.

As a method of detecting a toner level, an electrostatic capacity detection method and a method of detecting a dot count and a motor driving time may be used. In the electrostatic capacity detection method, an electrostatic capacity sensor may be disposed in the development chamber 60 to detect a toner level, and whether to supply toner or not is determined based on the detected toner level. However, in order to detect an electrostatic capacity, toner having a magnetic component may have to be used, and thus, there may be a limitation in selecting the toner.

In the method of detecting a dot count and a motor driving time, a consumption amount of toner may be calculated based on dot counts counted from image information, and a motor driving time for toner supply may be counted to calculate a toner supply amount, thereby maintaining a toner level of the development chamber 60 in an appropriate range. According to this method, a consumption amount of toner may be dependent upon a printing environment, and also, if the properties of toner are degraded, the consumption amount of toner rapidly increases so that the consumption amount of toner calculated based on the dot counts and a real consumption amount of toner may be different.

Considering the above problem, a toner level detecting unit 310 that uses an optical detection method may be used according to an embodiment of the disclosure. According to the optical detection method, an optical sensor may be mounted in the development chamber 60 to detect a toner level based on a difference in amounts of detected light according to the toner level.

Figure 5:
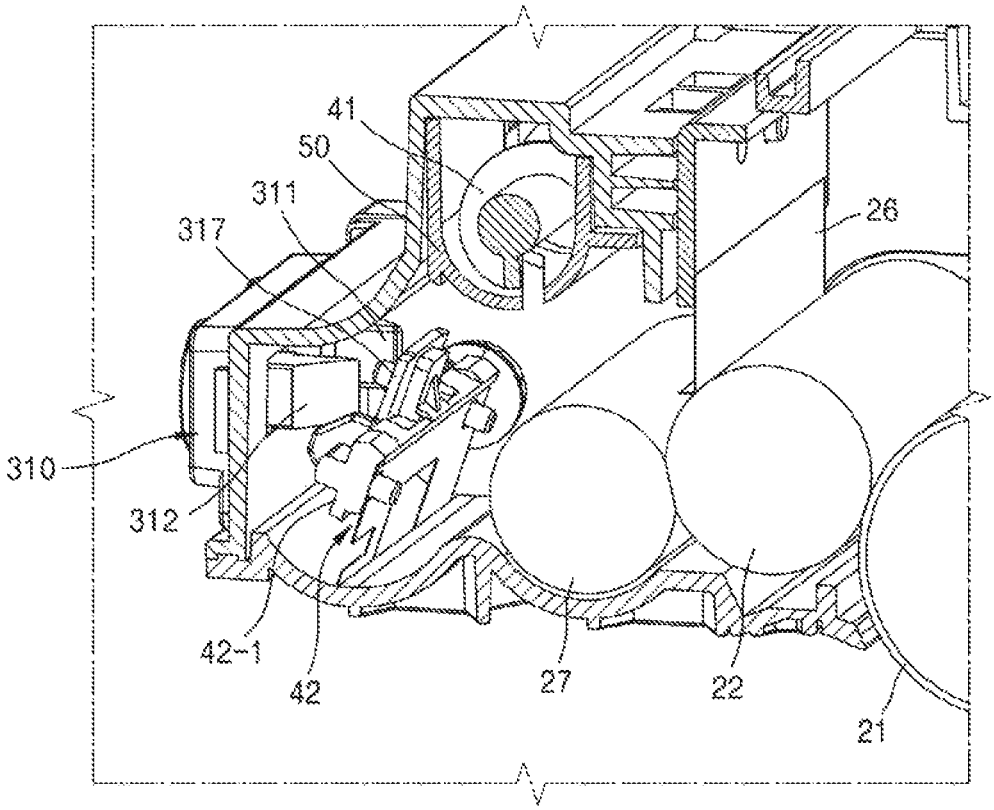
FIG. 5 is a partial cross-sectional perspective view of a developing unit in which a toner level detecting unit is disposed.
Figure 6A:
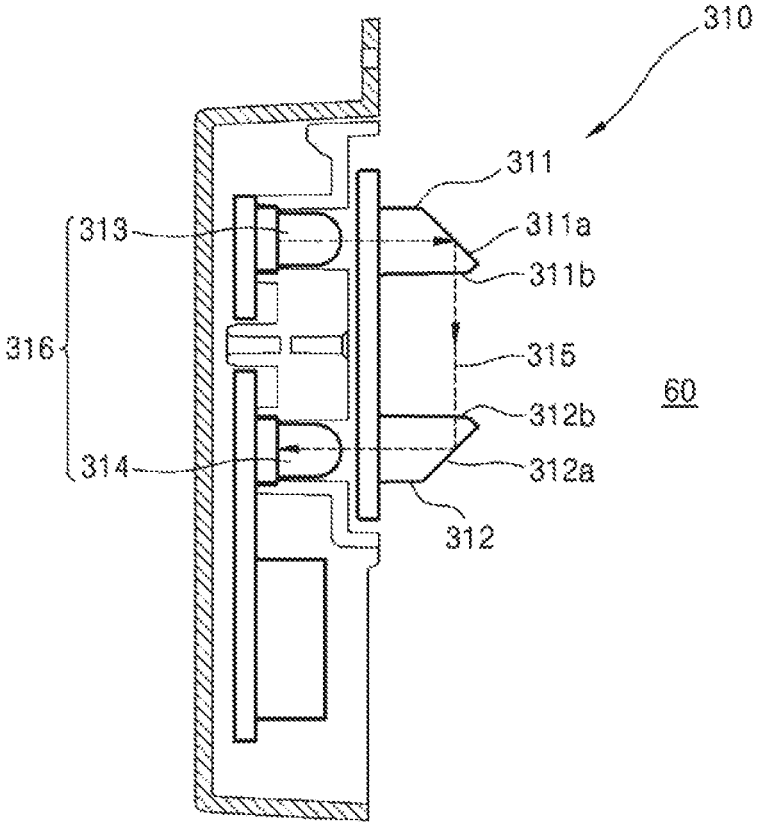
FIG. 6A is a schematic structural diagram of a toner level detecting unit.
Figure 6B:
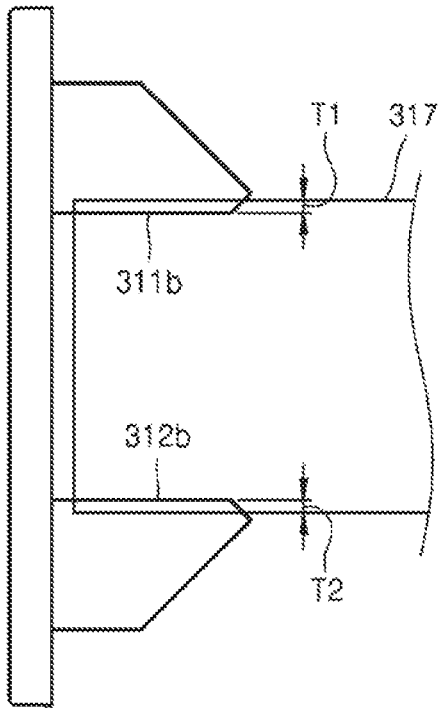
FIG. 6B illustrates an overlapping amount between a wiper and a light exit surface and a light incident surface.

FIG. 5 is a partial cross-sectional perspective view of the developing unit 300 in which the toner level detecting unit 310 is disposed. FIG. 6A is a schematic structural diagram of the toner level detecting unit 310. FIG. 6B illustrates overlapping amounts T1 and T2 between a wiper 317 and a light exit surface 311*b* and a light incident surface 312*b*, respectively.

Referring to FIGS. 5 and 6A, the toner level detecting unit 310 may include an optical sensor 316. The optical sensor 316 may include a light emitting unit 313 and a light receiving unit 314. Light 315 emitted from the light emitting unit 313 may pass through the development chamber 60 to be incident to the light receiving unit 314. The light emitting unit 313 and the light receiving unit 314 may be disposed outside the development chamber 60 in order to prevent pollution thereof by toner. A light guide member that guides the light 315 emitted from the light emitting unit 313 to pass through the development chamber 60 up to the light receiving unit 314 may be provided. The light guide member may include first and second light guide members 311 and 312. The first and second light guide members 311 and 312 may be spaced apart from each other in the development chamber 60. The first light guide member 311 may guide the light 315 emitted from the light emitting unit 313 to the development chamber 60. The second light guide member 312 may guide the light 315 that has passed through the development chamber 60 to the light receiving unit 314. The first and second light guide members 311 and 312 may respectively include first and second light path converting units 311*a* and 312*a*. The first light path converting unit 311*a* may reflect the light 315 emitted from the light emitting unit 313, toward the second light path converting unit 312*a*, and the second light path converting unit 312*a* may reflect the incident light 315 toward the light receiving unit 314. The first and second light guide members 311 and 312 may be formed of a light-transmissive material such that the light 315 may pass therethrough. The first and second light path converting units 311*a* and 312*a* may be, for example, inclined surfaces having a predetermined inclination angle. An inclination angle of the inclined surfaces may be, for example, an angle that satisfies a total internal reflection condition. The first and second light guide members 311 and 312 may have a same or similar shape and/or have a similar or same size, or the first and second light guide members 311 and 312 may have a different shape and/or have a different size from one another.

A reference position of the light 315 that passes through the development chamber 60 may be set by considering a reference toner level in the development chamber 60. For easy or smooth toner supply to the development roller 22, a toner level in the development chamber 60 may be maintained at a level at which at least a portion of the supply roller 27 may be soaked therein. Considering this, the reference position of the light 315 may be between a horizontal line L1 that is away by about 0 mm to about 2 mm from a vertex of an external circumferential surface of the supply roller 27, that is, an uppermost surface of the supply roller 27 in a gravitational direction, and a horizontal line L2 that passes through a rotational center of the supply roller 27.

According to the above-described structure, an amount of light detected by the light receiving unit 314 may be varied according to the toner level of the development chamber 60, and thus, the toner level in the development chamber 60 may be detected based on the amount of light received by the light receiving unit 314. When the toner level in the development chamber 60 is lower than a predetermined reference level, the first toner supply member 103 and the second toner supply member 104 may be driven to supply toner from the toner cartridge 100 to the development chamber 60. Accordingly, excessive supply of toner to the development chamber 60 and an increase in the toner pressure may be prevented to thereby reduce a stress applied to the toner. Also, as the optical sensor 316 may be located outside the development chamber 60 and thus does not directly contact the toner in the development chamber 60, the optical sensor 316 is not polluted by the toner.

The light exit surface 311*b* of the first light guide member 311 and the light incident surface 312*b* of the second light guide member 312 may face each other, and may contact toner in the developing unit 300. If the light exit surface 311*b* and the light incident surface 312*b* are polluted by the toner, it may be difficult to reliably detect the toner level. Referring to FIG. 5, the wiper 317 that wipes the light exit surface 311*b* and the light incident surface 312*b* may be provided in the development chamber 60. The wiper 317 may periodically wipe the light exit surface 311*b* and the light incident surface 312*b* to remove toner attached on the light exit surface 311*b* and the light incident surface 312*b*. According to an embodiment, the wiper 317 may be mounted at a rotational shaft 42-1 of the second toner transporting member 42 to rotate therewith and wipe the light exit surface 311*b* and the light incident surface 312*b*. This structure may improve reliability of detection of the toner level.

For example, a blade (sheet) or a brush that is formed of a flexible material such as urethane may be used as the wiper 317. The overlapping amounts T1 and T2 between the wiper 317 and the light exit surface 311*b* and the light incident surface 312*b* and a thickness of the wiper 317 may be determined in consideration of cleaning performance and durability of the wiper 317. Table 1 below shows test results about cleaning performance and durability of a urethane blade having a thickness of about 2 mm used as the wiper 317.

TABLE 1

| | Overlapping amount (T1, T2: mm) | | | | | | |
|---|---|---|---|---|---|---|---|
| | 0.05 | 0.13 | 0.25 | 0.35 | 0.5 | 1 | 1.3 |
| Cleaning performance | X | Δ | ◎ | ◎ | ◎ | Δ | X |
| whether wiper | none | none | none | minute cracks | cracks are | cracks are | cracks are |

TABLE 1-continued

| | Overlapping amount (T1, T2: mm) | | | | | | |
|---|---|---|---|---|---|---|---|
| | 0.05 | 0.13 | 0.25 | 0.35 | 0.5 | 1 | 1.3 |
| cracks are generated after driving for 72 hours | | | | | generated | generated | generated |
| sensing values of optical sensor | NG | OK | OK | OK | OK | NG | NG |

Referring to Table 1, when the overlapping amounts T1 and T2 are in a range from about 0.13 to about 0.5, the optical sensor 316 has normal sensing values. When the overlapping amounts T1 and T2 are equal to or greater than about 0.5, cracks are generated in a portion where the wiper 317 and the light exit surface 311*b* and the light incident surface 312*b* overlap each other. Accordingly, the overlapping amounts T1 and T2 may be set to be in a range from about 0.2 to about 0.4.

Table 2 below shows test results about cleaning performance and durability of a urethane blade having a thickness of about 2 mm used as the wiper 317.

TABLE 2

| | Thickness (mm) | | | |
|---|---|---|---|---|
| | 0.5 | 1 | 2 | 3 |
| cleaning performance | X | ○ | ◎ | ◎ |
| whether wiper cracks are generated after driving for 72 hours | ◎ | ◎ | ◎ | Δ |
| sensing value of optical sensor | NG | OK | OK | OK |

Referring to Table 2, if the wiper 317 is too thin (e.g., less than 1 mm), cleaning performance is poor, and if the wiper 317 is too thick, cracks are generated. Considering this, a thickness of the wiper 317 may be about 1 mm to about 3 mm.

A toner level in the development chamber 60 may be varied according to a position of the toner level detecting unit 310 in the length direction of the development chamber 60 (axial direction of the supply roller 27). Accordingly, when one toner level detecting unit 310 is used, a detected toner level may be different from a real toner level of the development chamber 60, and a difference between the detected toner level and the real toner level may not be corrected. Considering this, a plurality of toner level detecting units 310 may be disposed along the length direction of the development chamber 60. The number of and intervals between the toner level detecting units 310 may be different according to a shape and length of the development chamber 60, for example. Hereinafter, an embodiment in which two toner level detecting units 310 are used will be described.

Figure 7:
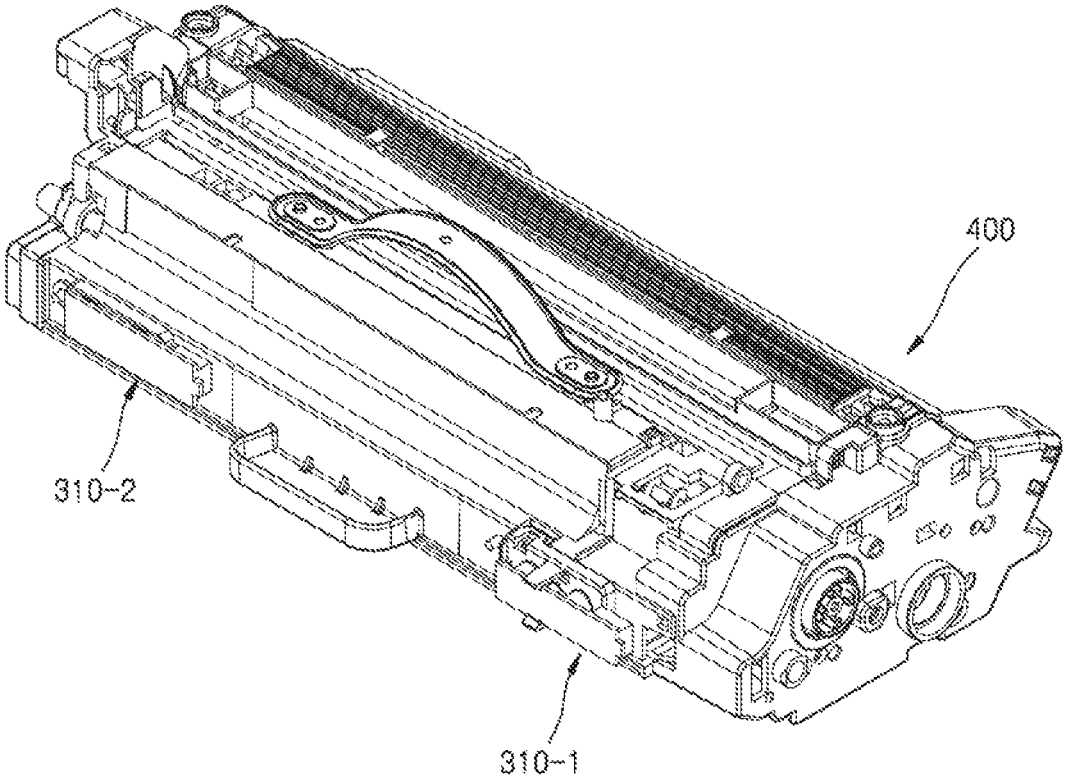
FIG. 7 is a perspective view of an imaging cartridge according to an embodiment.

FIG. 7 is a perspective view of an imaging cartridge 400 according to an embodiment. Referring to FIG. 7, first and second toner level detecting units 310-1 and 310-2 are illustrated. The first and second toner level detecting units 310-1 and 310-2 may be spaced apart from each other in the length direction of the development chamber 60. For example, the first toner level detecting unit 310-1 may be disposed at a first end portion of the development chamber 60 in the length direction, and the second toner level detecting unit 310-2 may be disposed at a second end portion of the development chamber 60 in the length direction. Structures of the first and second toner level detecting units 310-1 and 310-2 may be respectively the same as the structure of the toner level detecting unit 310 illustrated in FIGS. 5 and 6A.

According to this structure, a toner level may be detected at both sides of the development chamber 60 in the length direction, and thus, the toner level of the development chamber 60 may be reliably detected. Also, two toner level detecting units, that is, the first and second toner level detecting units 310-1 and 310-2 are used, and thus, the toner level may be detected even when one of them is out of order, thereby stably maintaining the toner level of the development chamber 60. As noted above, the number of toner level detecting units may be based on a shape and length of the development chamber 60, for example. Thus, there may be more than two toner level detecting units (e.g., three, four, or more than four, for example).

Figure 8:
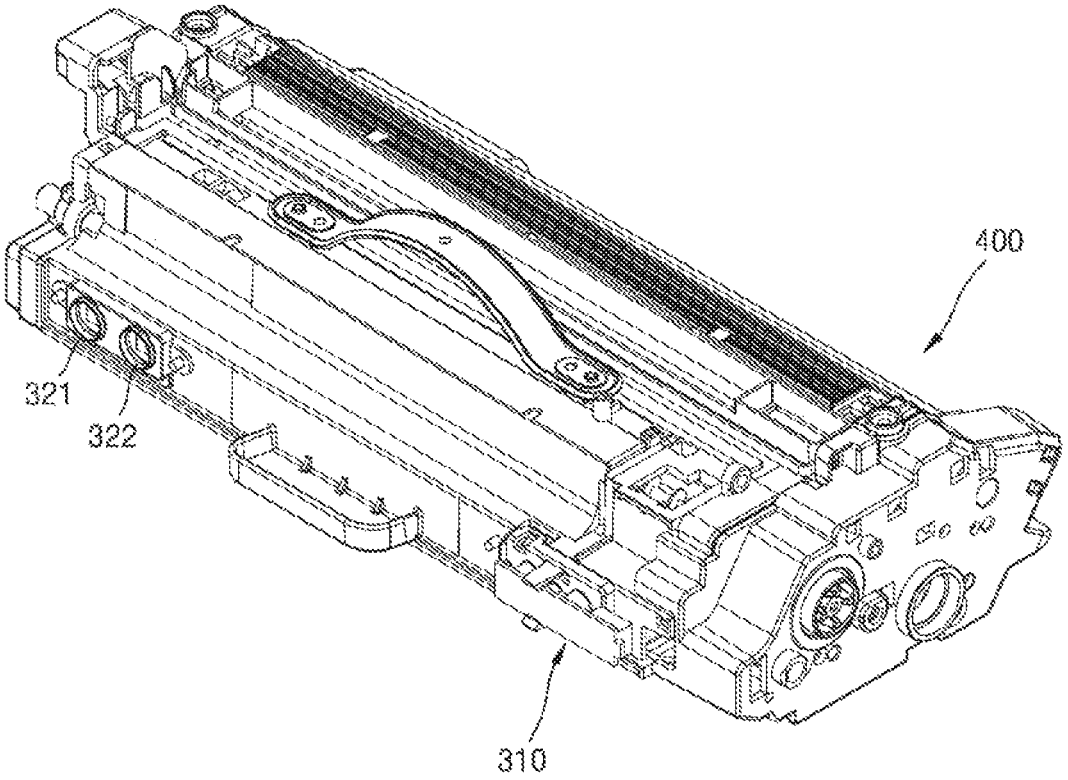
FIG. 8 is a perspective view of an imaging cartridge according to an embodiment.
Figure 9:
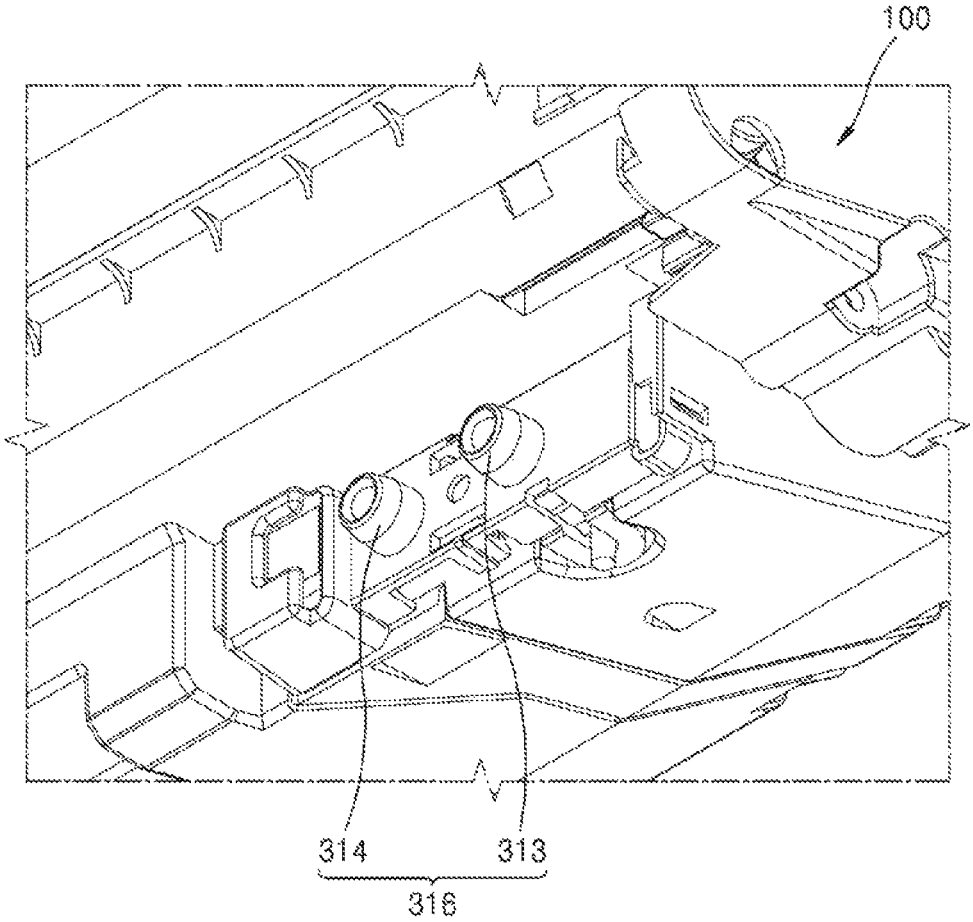
FIG. 9 is a perspective view of a toner cartridge according to an embodiment.
Figure 10:
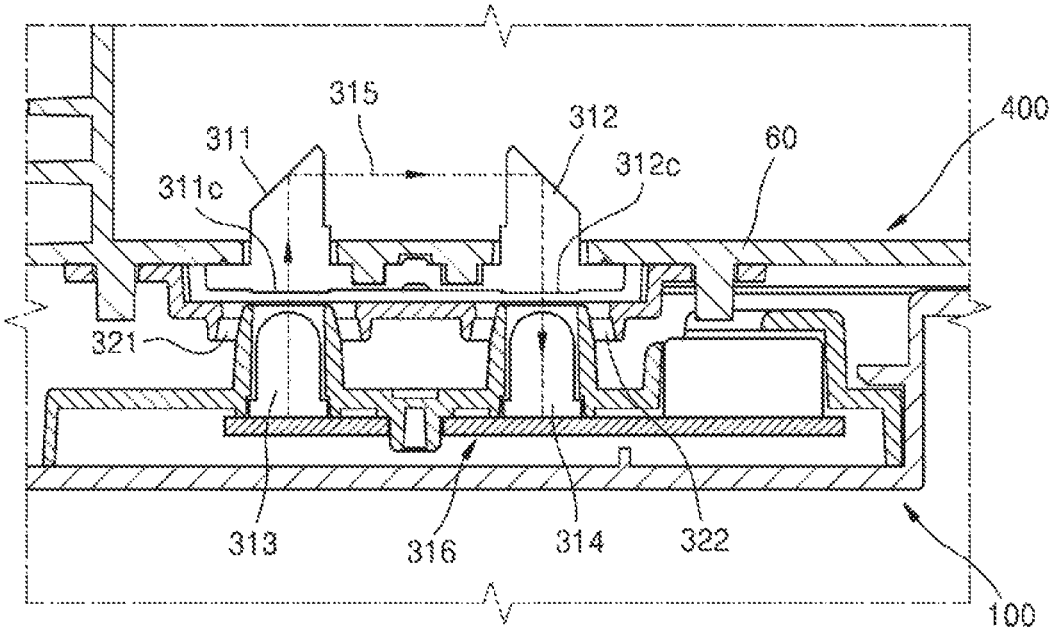
FIG. 10 is a cross-sectional view of a second toner level detecting unit when an imaging cartridge and a toner cartridge are mounted in a main body.

FIG. 8 is a perspective view of the imaging cartridge 400 according to an embodiment. FIG. 9 is a perspective view of the toner cartridge 100 according to an embodiment. FIG. 10 is a cross-sectional view of the second toner level detecting unit 310-2 when the imaging cartridge 400 and the toner cartridge 100 are mounted in the main body 1.

One of the first and second toner level detecting units 310-1 and 310-2 may be mounted in the imaging cartridge 400, and the other may be mounted in the toner cartridge 100. For example, as illustrated in FIGS. 8 and 9, the first toner level detecting unit 310-1 may be mounted in the imaging cartridge 400, and the second toner level detecting unit 310-2 may be mounted in the toner cartridge 100. A structure of the first toner level detecting unit 310-1 may be the same as that of the toner level detecting unit 310 illustrated in FIGS. 5 and 6A. Like the toner level detecting unit 310 illustrated in FIGS. 5 and 6A, the second toner level detecting unit 310-2 also may include an optical sensor 316 and first and second light guide members 311 and 312. The first and second light guide members 311 and 312 are to be inserted into the development chamber 60, and thus, when the first and second light guide members 311 and 312 are mounted in the toner cartridge 100, an insertion hole (not shown) through which the first and second light guide members 311 and 312 are inserted is to be provided in the developing unit 300, and toner may leak through this insertion hole. Considering this, the optical sensor 316 of the second toner level detecting unit 310-2 may be mounted in the toner cartridge 100 as illustrated in FIG. 9 and FIG. 10, and the first and second light guide members 311 and 312 of the second toner level detecting unit 310-2 may be mounted in the imaging cartridge 400 as illustrated in FIGS. 8 and 10.

Rear surfaces 311*c* and 312*c* of the first and second light guide members 311 and 312 may be exposed out of the development chamber 60. First and second light windows 321 and 322 may be provided in the imaging cartridge 400. The light emitting unit 313 of the optical sensor 316 provided in the toner cartridge 100 irradiates light into the development chamber 60 through the first light window 321, and light that has passed through the development chamber 60 is incident to the light receiving unit 314 of the optical sensor 316 through the second light window 322. The first and second light windows 321 and 322 may respectively surround the rear surfaces 311*c* and 312*c* of the first and second light guide members 311 and 312. Referring to FIGS. 9 and 10, the optical sensor 316 may include the light emitting unit 313 and the light receiving unit 314 at positions respectively facing the first and second light guide members 311 and 312 and may be located in the toner cartridge 100. When the toner cartridge 100 is mounted in main body 1 while the imaging cartridge 400 is mounted, the light emitting unit 313 and the light receiving unit 314 respectively face the rear surfaces 311*c* and 312*c* of the first and second light guide members 311 and 312 through the first and second light windows 321 and 322, and accordingly, the second toner level detecting unit 310-2 may be implemented.

According to the above-described structure, when the toner cartridge 100 is replaced, the optical sensor 316 of the second toner level detecting unit 310-2 may also be replaced. Also, when the imaging cartridge 400 is replaced, not only the first toner level detecting unit 310-1 is replaced but the first and second light guide members 311 and 312 of the second toner level detecting unit 310-2 are also replaced. As described above, replacement periods of the toner cartridge 100 and the imaging cartridge 400 may be different, and in general, the replacement period of the imaging cartridge 400 is longer than that of the toner cartridge 100. Accordingly, the toner cartridge 100 is more frequently replaced than the imaging cartridge 400. Thus, when one of the two cartridges 100 and 400 is replaced, one of at least two optical sensors 316 may be replaced. Accordingly, possibility of error in detection of the toner level due to trouble in operation or pollution of the first and second toner level detecting units 310-1 and 310-2 may be reduced. In an alternative embodiment, the optical sensor 316 of the first toner level detecting unit 310-1 and the optical sensor 316 of the second toner level detecting unit 310-2 may be mounted in the toner cartridge 100. In such an arrangement, first and second light guide members 311 and 312 of the first toner level detecting unit 310-1 may be mounted in the imaging cartridge 400, and first and second light guide members 311 and 312 of the second toner level detecting unit 310-2 may be mounted in the imaging cartridge 400.

Figure 11:
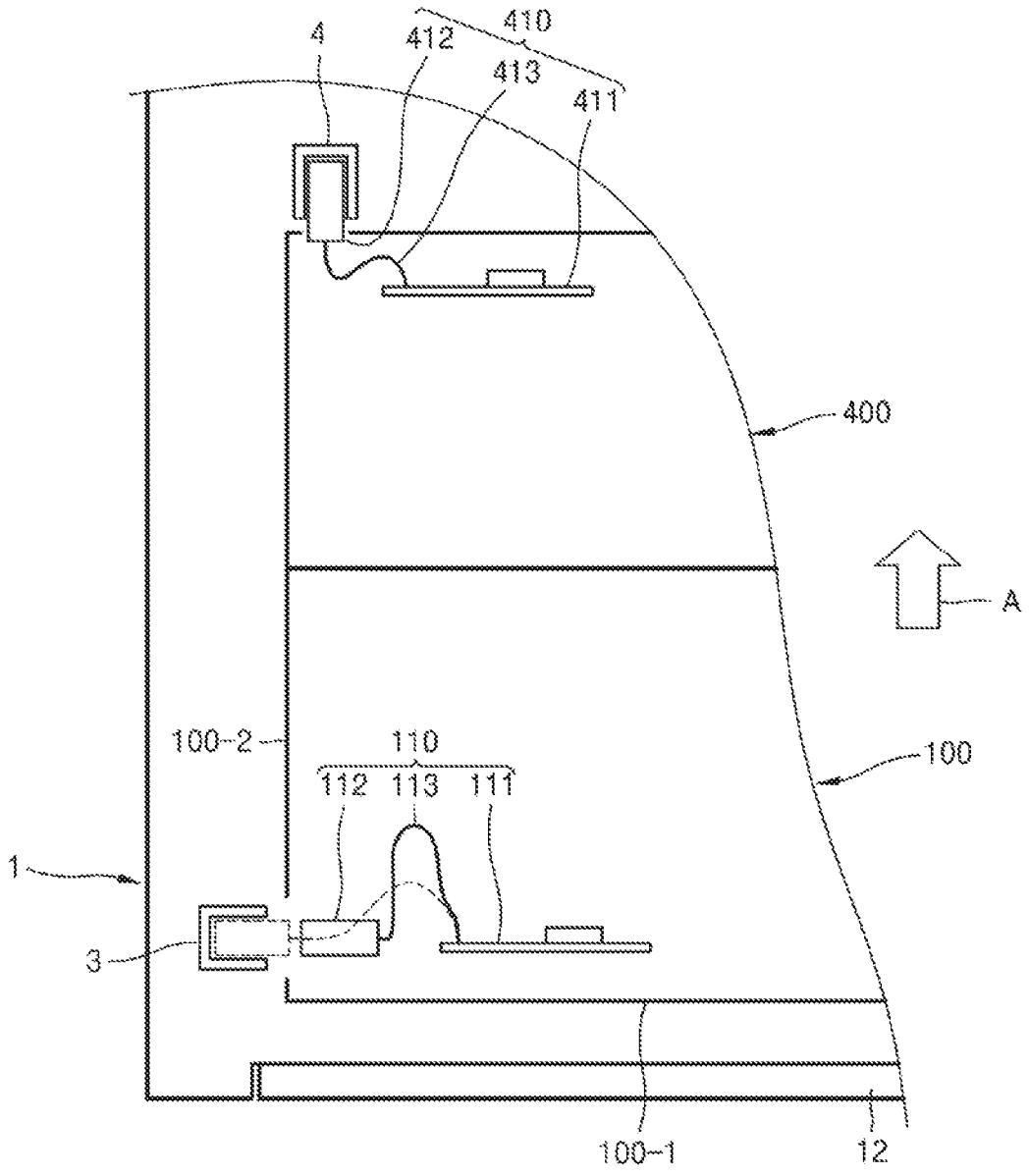
FIG. 11 is a partial plan view of an image forming apparatus according to an embodiment.

FIG. 11 is a partial plan view of the image forming apparatus according to an embodiment. Referring to FIG. 11, first and second memory units 110 and 410 may be included in the toner cartridge 100 and the imaging cartridge 400, respectively. When the toner cartridge 100 and the imaging cartridge 400 are mounted in the main body 1, the first and second memory units 110 and 410 are electrically connected to the main body 1 to transmit information of the toner cartridge 100 and the imaging cartridge 400 to the main body 1. The main body 1 may determine whether the toner cartridge 100 and the imaging cartridge 400 are mounted, by determining whether the first and second memory units 110 and 410 are electrically connected to the main body 1, for example, by determining whether communication with the first and second memory units 110 and 410 is possible or not.

The first and second memory units 110 and 410 may respectively include first and second circuit units 111 and 411 to monitor or manage a state of the toner cartridge 100 and the imaging cartridge 400 and first and second contact portions 112 and 412 via which the first and second memory units 110 and 410 are respectively connected to the main body 1. The first and second circuit units 111 and 411 may each include at least one customer replaceable unit monitor (CRUM) unit including at least one central processing unit (CPU) that performs at least one of authentication and/or coding of data communication with respect to the main body 1 by using, for example, an operating system (OS) included in the first and second circuit units 111 and 411. The first and second circuit units 111 and 411 may further include a memory.

A memory of the first circuit unit 111 may store various types of information about the toner cartridge 100. For example, specific information such as manufacturer information, manufacture date information, a serial number, or a model number, various programs, electronic signature information, and usage state (for example, a number of pages printed so far, a number of remaining printable pages, or an amount of toner left) may be stored in the memory. Also, the memory of the first circuit unit 111 may store the lifetime or setup menus of the toner cartridge 100.

A memory of the second circuit unit 411 may store various types of information about the imaging cartridge 400, for example, specific information such as manufacturer information, manufacture date information, a serial number, or a model number, various programs, electronic signature information, and usage state (for example, a number of pages printed so far, a number of remaining printable pages, or an amount of toner left). Also, the memory may store the lifetime or setup menus of the imaging cartridge 400.

In addition, the first and second circuit units 111 and 411 may include a functional block capable of performing various functions for communication, authentication, or coding. The first and second circuit units 111 and 411 may be in the form of a chip including a CPU, a chip including a memory and a CPU, or a printed circuit board on which chips and circuit elements for implementing various functional blocks are mounted.

The first and second contact portions 112 and 412 may be integrally formed with a printed circuit board of the first and second circuit units 111 and 411, or may be respectively connected to the first and second circuit units 111 and 411 via first and second signal lines 113 and 413 as illustrated in FIG. 11. The first and second contact portions 112 and 412 may be, for example, a modular jack. First and second connection portions 3 and 4 that are respectively connected to the first and second contact portions 112 and 412 may be provided in the main body 1. The first and second connection portions 3 and 4 may be each in the form of a modular connector into which the first and second contact portions 112 and 412 in the form of a modular jack are inserted. Also, the first and second contact portions 112 and 412 may be in the form of a conductive pattern. The first and second contact portions 112 and 412 in the form of a conductive pattern may be formed on a circuit board which is not shown, or may be integrally formed with a printed circuit board of the first and second circuit units 111 and 411. The first and second memory units 110 and 410 may be in the form of a package, in which the first and second circuit unit 111 and 411 may be included and from which the first and second contact portions 112 and 412 may be exposed to the outside, and the first and second contact portions 112 and 412 may be in the form of a conductive pattern and may be exposed out of the package. In this case, the first and second connection portions 3 and 4 may include a pin type terminal that is electrically connectable to the first and second contact portions 112 and 412 which is in the form of a conductive pattern. Also, the first and second contact portions 112 and 412 may be a pin type terminal, and the first and second connection portions 3 and 4 may be in the form of a conductive pattern to which the pin type terminal is connected. Alternatively, the first and second contact portions 112 and 412 and the first and second connection portions 3 and 4 may have various forms whereby they may be electrically connected to each other.

For example, as illustrated in FIG. 11, the second contact portion 412 of the imaging cartridge 400 may protrude from the front of the imaging cartridge 400, and when the imaging cartridge 400 is mounted in the main body 1, the second contact portion 412 may be inserted into the second connection portion 4 provided in the main body 1 so as to be electrically connected to the main body 1, thereby transmitting information of the imaging cartridge 400 to the main body 1.

In the case of the imaging cartridge 400 illustrated in FIG. 7, the first and second toner level detecting units 310-1 and 310-2 may be electrically connected to the second memory unit 410, and may transmit detection signals of the first and second toner level detecting units 310-1 and 310-2 to the main body 1 via the second contact portion 412 and the second connection portion 4. In the case of the imaging cartridge 400 illustrated in FIG. 8, a detection signal of the first toner level detecting unit 310-1 may be transmitted to the main body 1 via the second contact portion 412.

When the toner cartridge 100 is mounted in the main body 1, the first contact portion 112 may be inserted into the first connection portion 3 provided in the main body 1 so as to be electrically connected to the main body 1. Consequently, information of the toner cartridge 100 may be transmitted to the main body 1. In the case of the toner cartridge 100 illustrated in FIG. 9, a detection signal of the second toner level detecting unit 310-2 may be transmitted to the main body 1 via the first contact portion 112.

As illustrated in FIG. 11 by a dotted line, when the first contact portion 112 protrudes out of the toner cartridge 100, the first contact portion 112 may be polluted or damaged while handling the toner cartridge 100. Also, when mounting the toner cartridge 100 in the main body 1, the first contact portion 112 may be damaged due to collision with the main body 1. Damage to or pollution of the first contact portion 112 may be the cause of a contact defect between the first contact portion 112 and the first connection portion 3. To solve or address this problem, the first memory unit 110 may include the first contact portion 112 that is movable to a first position (a position illustrated in FIG. 11 by a solid line) that is hidden inside the toner cartridge 100 and a second position (a position illustrated in FIG. 11 by a dotted line) that protrudes from the toner cartridge 100. When the toner cartridge 100 is mounted in the main body 1, the first contact portion 112 may be moved to the second position at which the first contact portion 112 is electrically connected to the first connection portion 3 included in the main body 1, and before the toner cartridge 100 is detached from the main body 1, the first contact portion 112 may be moved to the first position where electrical connection between the first contact portion 112 and the first connection portion 3 is terminated. A protruding direction of the first contact portion 112 at the second position is not limited. The first contact portion 112 may be protruded in various directions, for example, to a side portion 100-2, an upper portion, a lower portion, a front portion, or a rear portion 100-1 of the toner cartridge 100. Hereinafter, an embodiment will be described, in which the first contact portion 112 is protruded to the side portion 100-2 of the toner cartridge 100 that is orthogonal to a mounting direction A.

Figure 12:
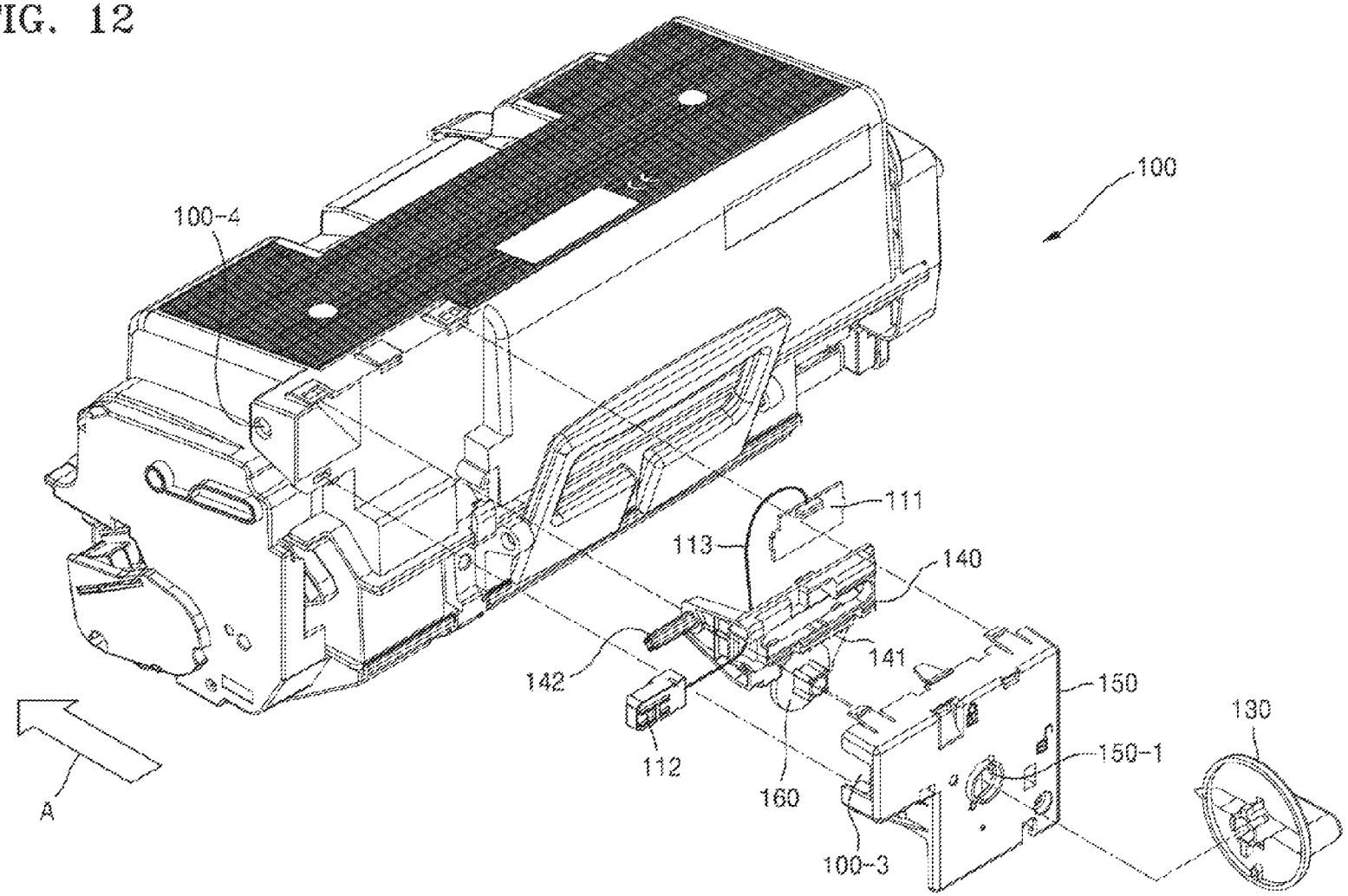
FIG. 12 is a disassembled perspective view of a toner cartridge including a moving structure for moving a contact portion to first and second positions by manual manipulation, according to an embodiment.

The first contact portion 112 may be moved to the first or second position via manual manipulation of a user. FIG. 12 is a perspective view of the toner cartridge 100 having a movement structure for moving the first contact portion 112 to the first or second position via manual manipulation, according to an embodiment.

Referring to FIG. 12, with respect to the mounting direction A, a knob 130 may be formed at a rear portion 100-1 of the toner cartridge 100. A moving member 140 may be slidably installed in the toner cartridge 100. The moving member 140 may be slidably installed in an inner portion of a rear cover 150 that is coupled to the rear portion 100-1 of the toner cartridge 100. The first contact portion 112 may be fixed to the moving member 140 and may be connected to the first circuit unit 111 via the signal line 113. The knob 130 may be connected to the moving member 140 via a conversion unit. Rotation of the knob 130 may be converted into a linear sliding movement of the moving member 140 via the conversion unit. For example, the conversion unit may be realized by a pinion 160 and a rack gear 141. The rack gear 141 may be formed on the moving member 140. The pinion 160 may be installed in the inner portion of the rear cover 150 to be engaged with the rack gear 141. The knob 130 may be inserted into an installation hole 150-1 formed in the rear cover 150 to be connected to the pinion 160.

According to the above structure, when the knob 130 is rotated, rotation of the knob 130 is converted into linear movement of the moving member 140 via the pinion 160 and the rack gear 141, and the first contact portion 112 may be moved to the first position which is hidden inside the toner cartridge 100 and the second position protruding from the side portion 100-2 of the toner cartridge 100 through a first exit hole 100-3. A movement direction of the first contact portion 112 may be determined according to a structure of the conversion unit. For example, a conversion unit including a bevel gear may be used to move the moving member 140 in a width direction or a height direction of the toner cartridge 100, and the first contact portion 112 may protrude from a front portion or upper portion of the toner cartridge 100 to be located at the second position.

The knob 130 may be located at the rear portion 100-1 of the toner cartridge 100 so that a user may easily access the knob 130 via the opening 11 that is opened via the door 12 when the toner cartridge 100 is attached to or detached from the main body 1.

Referring to FIG. 12, a protection member 142 that prevents collision between the first contact portion 112 and the main body 1 or the first connection portion 3 is illustrated. The protection member 142 may be moved together with the first contact portion 112 via manipulation of the knob 130. That is, the protection member 142 may have a retreat position which is hidden inside the toner cartridge 100 and a protruding position protruding from the toner cartridge 100. For example, the protection member 142 may be integrally formed with the moving member 140.

Figure 13A:
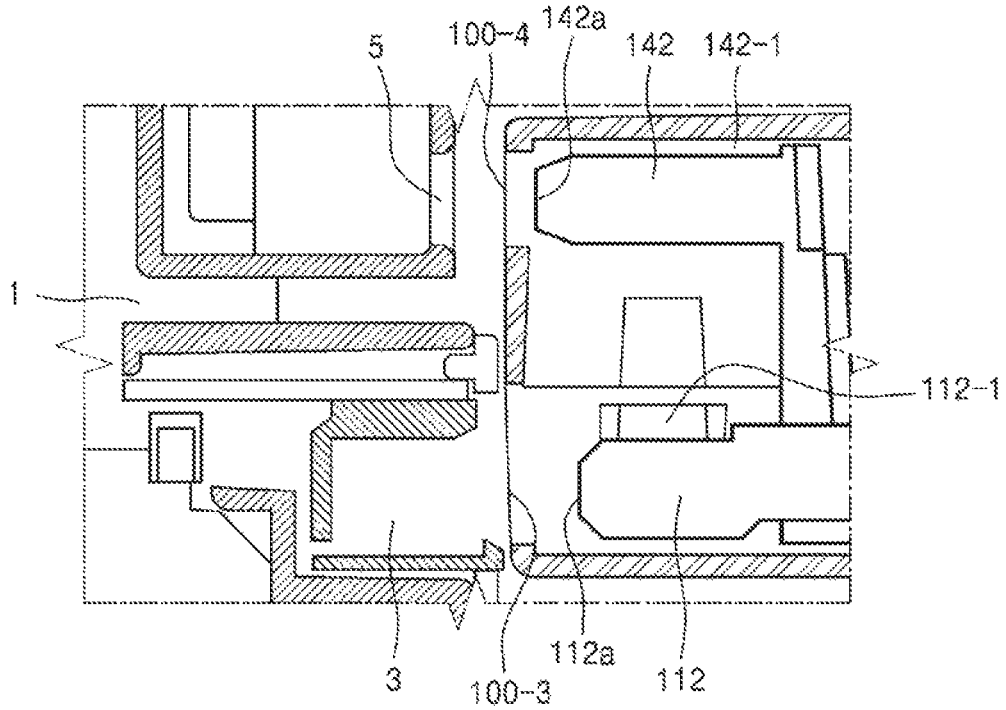
FIG. 13A is a plan view illustrating the toner cartridge mounted in the main body, wherein a contact portion and a protection member are respectively located at a first location and a retreat location.
Figure 13B:
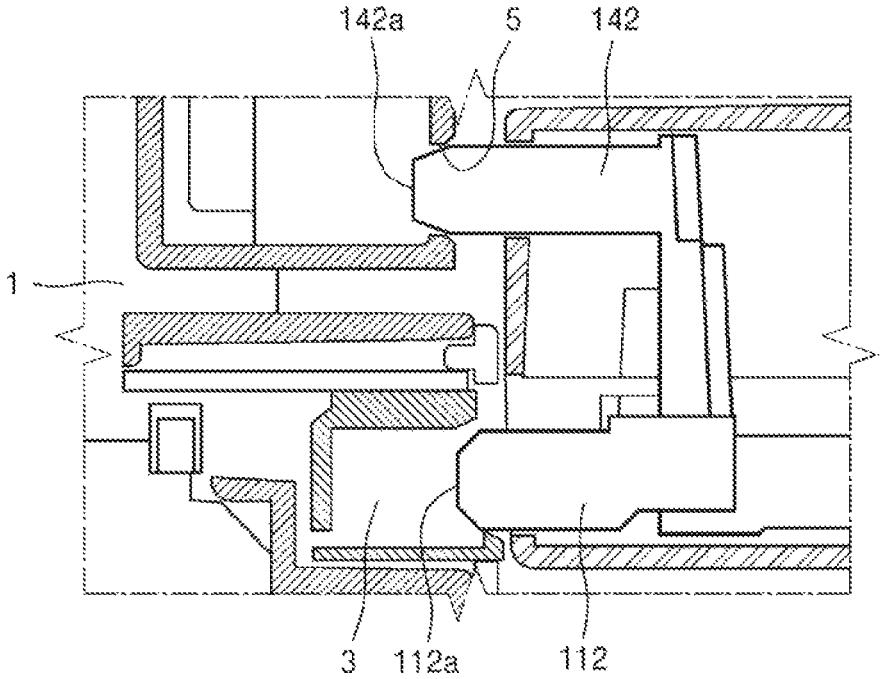
FIG. 13B is a plan view illustrating the toner cartridge mounted in the main body, wherein a contact portion and a protection member are respectively moved to a second location and a protruding location.
Figure 13C:
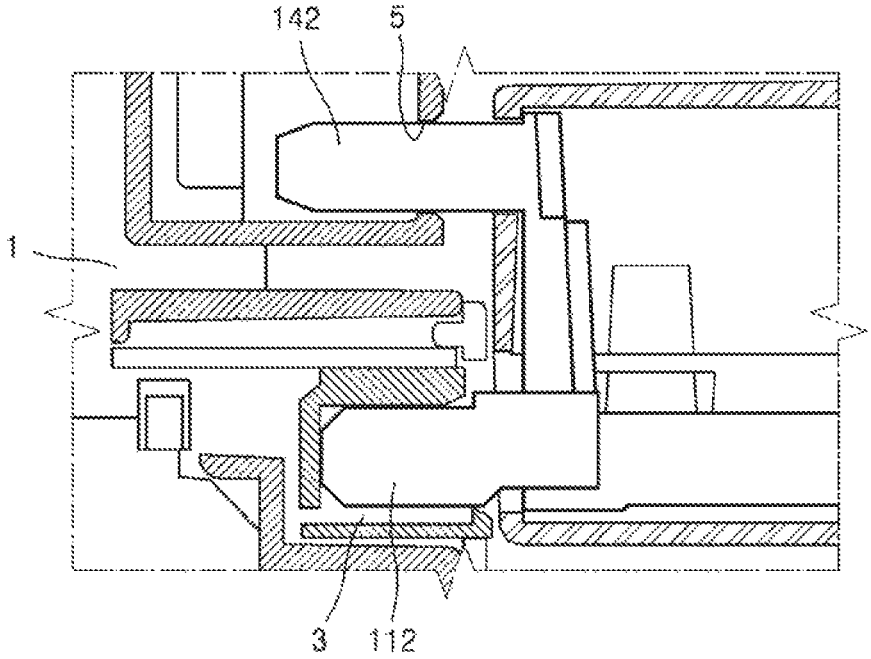
FIG. 13C is a plan view illustrating the toner cartridge mounted in the main body, wherein a contact portion and a protection member are respectively located at a second location and a protruding location.

FIG. 13A is a plan view illustrating the toner cartridge 100 mounted in the main body 1, wherein the first contact portion 112 and the protection member 142 may be respectively located at a first location and a retreat location. FIG. 13B is a plan view illustrating the toner cartridge 100 mounted in the main body 1, wherein the first contact portion 112 and the protection member 142 are respectively moved to a second location and a protruding location. FIG. 13C is a plan view illustrating the toner cartridge 100 mounted in the main body 1, wherein the first contact portion 112 and the protection member 142 are respectively located at the second location and the protruding location.

Referring to FIG. 13A, with respect to the mounting direction A, the protection member 142 may be located before the first contact portion 112. That is, a forefront surface 142-1 of the protection member 142 in the mounting direction A may be located before (in advance of) a forefront surface 112-1 of the first contact portion 112 in the mounting direction A. According to the above structure, when the first contact portion 112 is located at the second position, the protection member 142 may be located at the protruding position. When mounting the toner cartridge 100 in the main body 1 while the first contact portion 112 is located at the second position, the protection member 142 may first contact the main body 1 or the first connection portion 3 before the first contact portion 112 contacts the main body 1 or the first connection portion 3. Accordingly, collision between the first contact portion 112 and the main body 1 or the first connection portion 3 during a mounting operation may be prevented.

The toner cartridge 100 may be mounted in the main body 1 as illustrated in FIG. 13A while the first contact portion 112 and the protection member 142 are respectively located at the first position and the retreat position. When the knob 130 is rotated in this state, the moving member 140 slides, and the first contact portion 112 and the protection member 142 slide together respectively to the second position and the protruding position. An insertion portion 5 into which the protection member 142 is inserted may be provided in the main body 1. The protection member 142 may be moved from a first position (retreat position) which may be hidden inside the toner cartridge 100 to a second position (protruding position) which protrudes from the side portion 100-2 of the toner cartridge 100, through a second exit hole 100-4.

Referring to FIG. 13B, a front end portion 142*a* of the protection member 142 protrudes further than the front end portion 112*a* of the first contact portion 112 in the protruding direction. While the first contact portion 112 and the first connection portion 3 are not completely aligned, that is, while the toner cartridge 100 is not completely inserted, if the first contact portion 112 is inserted into the first connection portion 3, the first contact portion 112 may collide with the first connection portion 3 and be damaged. According to one or more embodiments of the disclosure, the protection member 142 may be inserted into the insertion portion 5 before the first contact portion 112 is inserted into the first connection portion 3, thereby aligning the first contact portion 112 and the first connection portion 3. Consequently, possibility of damage to the first contact portion 112 during insertion into the first connection portion 3 may be reduced. When the knob 130 is completely rotated, the first contact portion 112 may be located at the second position where it is inserted into the first connection portion 3, as illustrated in FIG. 13C, and the protection member 142 may be located at the protruding position where it is inserted into the insertion portion 5. When the toner cartridge 100 is to be detached from the main body 1 in a state as illustrated in FIG. 13C, as the first contact portion 112 is inserted into the first connection portion 3, a force may be applied to the first contact portion 112. According to one or more embodiments of the disclosure, as the protection member 142 is also inserted into the insertion portion 5, the force applied to the first contact portion 112 may be dispersed via the protection member 142. Accordingly, a possibility of damage to the first contact portion 112 may be reduced. As the protection member 142 is included as described above, a possibility of damage to the first contact portion 112 during mounting or detaching of the toner cartridge 100 may be reduced.

As described above, after mounting the toner cartridge 100 in the main body 1, the knob 130 may be manipulated to move the first contact portion 112 to the second position to thereby connect the first memory unit 110 to the main body 1. Then the door 12 may be closed. After mounting the toner cartridge 100 in the main body 1, if the door 12 is closed while the first contact portion 112 is not moved to the second position, the first memory unit 110 and the main body 1 are not connected. According to the image forming apparatus of one or more embodiments of the disclosure, the door 12 may not be allowed to be closed unless the first contact portion 112 is converted to the second position, thereby preventing a connection error between the toner cartridge 100 and the main body 1. In order to prevent a connection error, for example, an interference between the knob 130 and the door 12 may be used.

Figure 14A:
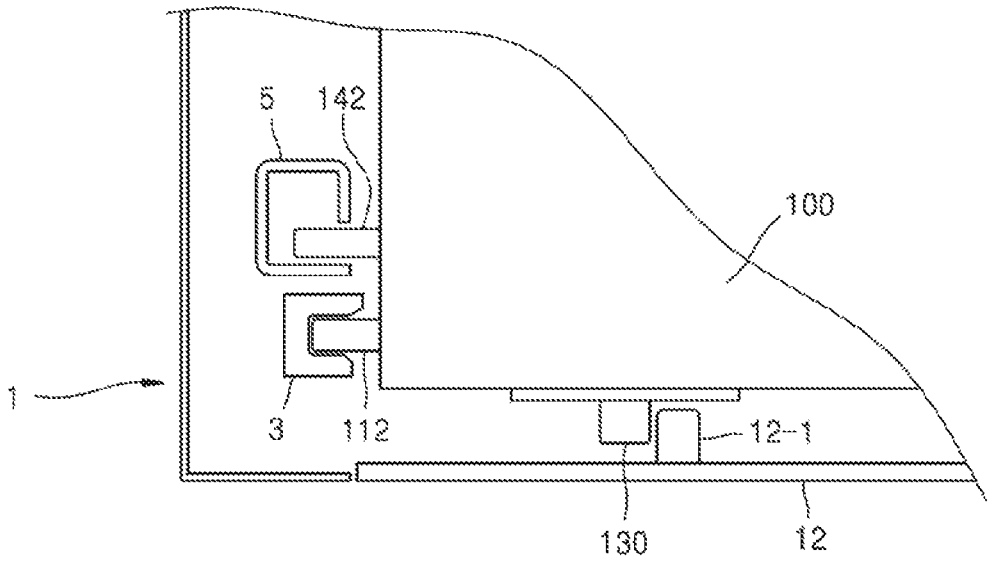
FIG. 14A is a schematic plan view illustrating an image forming apparatus including a connection error prevention structure, according to an embodiment of the disclosure.
Figure 14B:
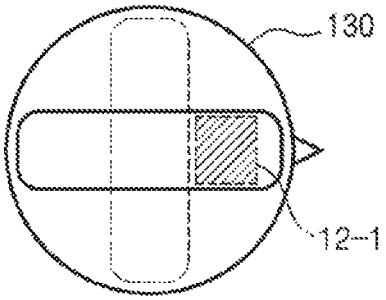
FIG. 14B illustrates a position relationship between a knob and an interference portion according to a position of a contact portion.

FIG. 14A is a schematic plan view illustrating an image forming apparatus including a connection error prevention structure, according to an embodiment. FIG. 14B illustrates a position relationship between the knob 130 and an interference portion 12-1 according to a position of the first contact portion 112. Referring to FIG. 14A, the interference portion 12-1 may protrude toward the knob 130 and may be formed on the door 12. When the first contact portion 112 is located at the first position, the knob 130 may be located at a position where the knob 130 interferes with the interference portion 12-1 as illustrated by a solid line in FIG. 14B. Also, when the first contact portion 112 is located at the second position, the knob 130 may be located at a position where the knob 130 does not interfere with the interference portion 12-1 as illustrated by a dotted line in FIG. 14B. Accordingly, if the door 12 is attempted to be closed while the toner cartridge 100 is mounted in the main body 1 and the first contact portion 112 is located at the first position, the interference portion 12-1 interferes with the knob 130 so that the door 12 is not closed.

Figure 15:
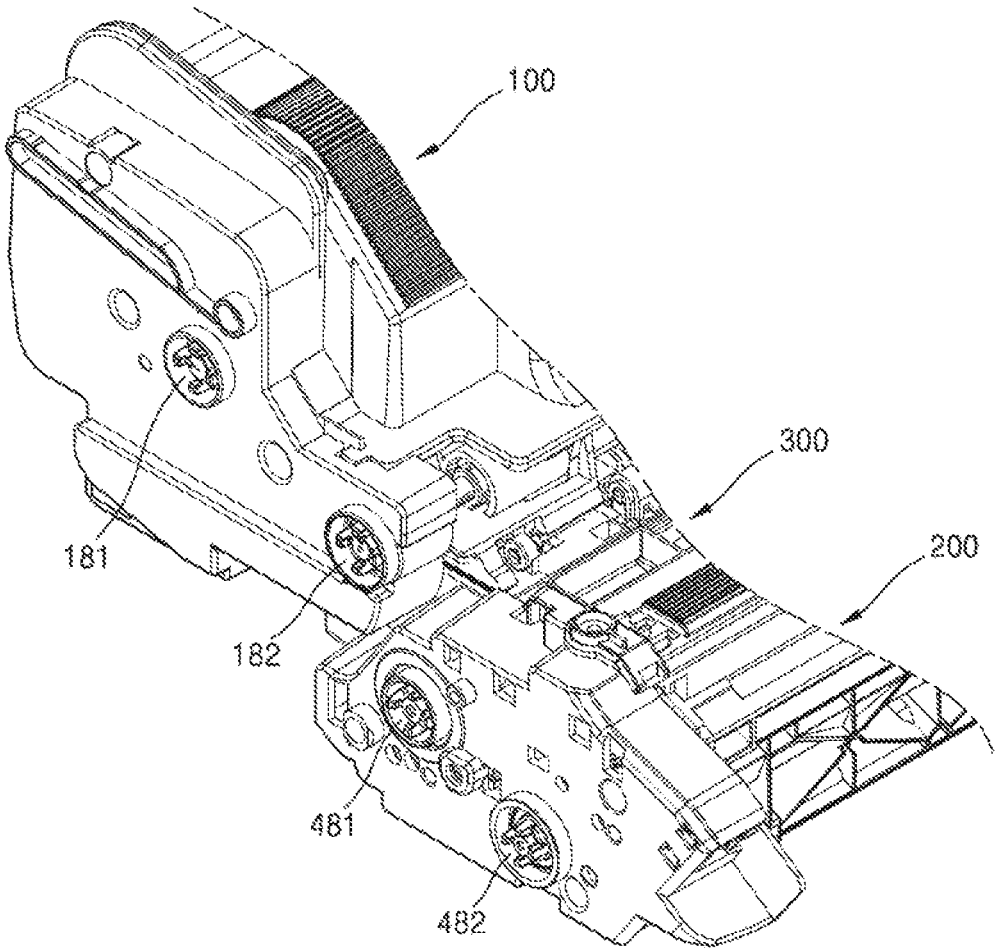
FIG. 15 is a perspective view of a process cartridge according to an embodiment.
Figure 16:
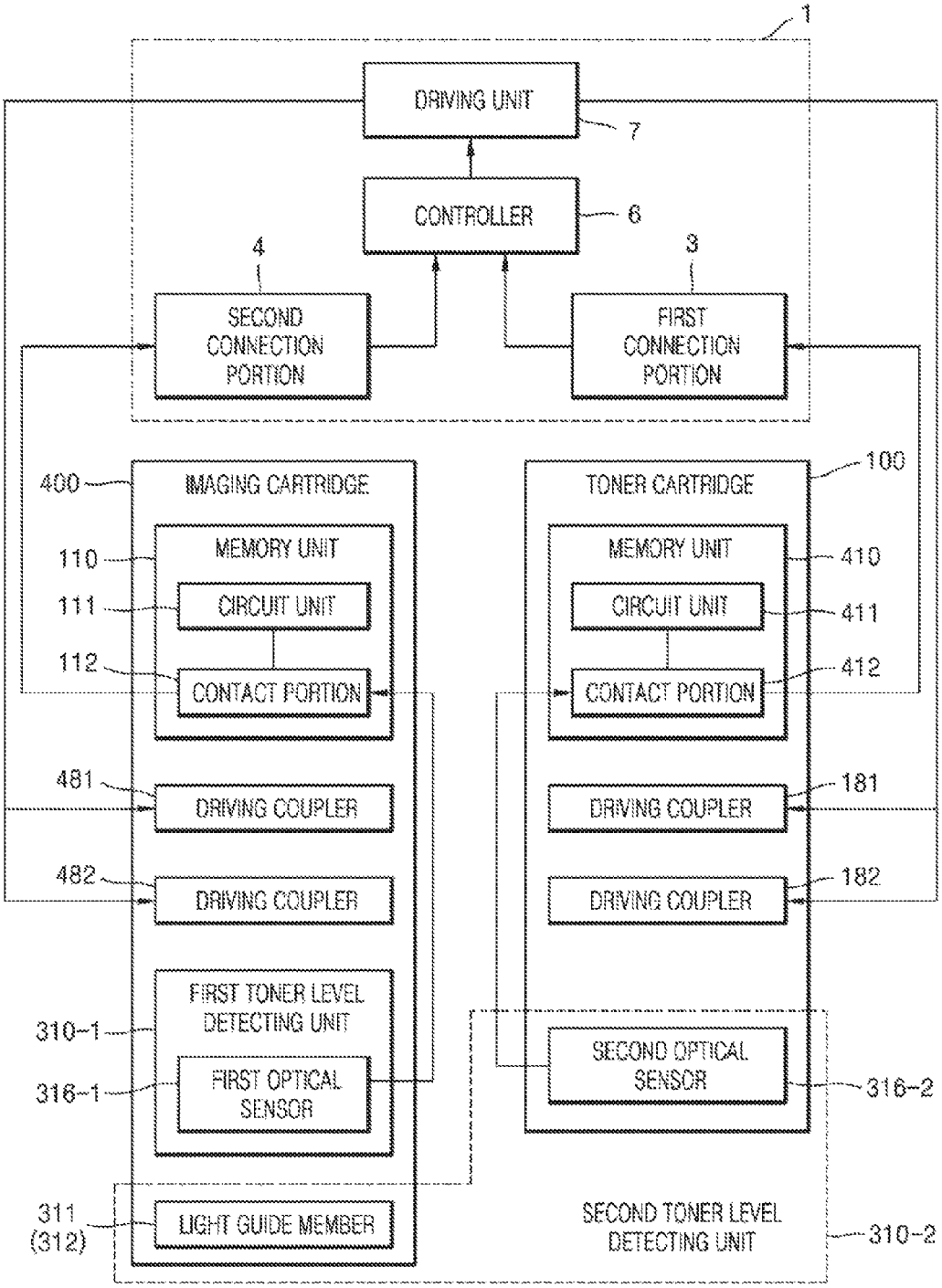
FIG. 16 is a system structure diagram of an image forming apparatus according to an embodiment.

FIG. 15 is a perspective view of the process cartridge 2 according to an embodiment. FIG. 16 is a system structural diagram of an image forming apparatus according to an embodiment. Referring to FIGS. 15 and 16, driving couplers 481 and 482 may be disposed at a side portion of the imaging cartridge 400. The driving coupler 481 may be connected to the development roller 22, the supply roller 27, and the first and second toner transporting members 41 and 42 disposed in the developing unit 300. The driving coupler 482 may be connected to the photoconductive drum 21, the charging roller 23, the cleaning roller 24, and the waste toner discharging member 43 disposed in the photoreceptor unit 200. Driving couplers 181 and 182 may be disposed at a side portion of the toner cartridge 100. The driving coupler 181 may be connected to the first toner supply member 103. The driving coupler 182 may be connected to the second toner supply member 104. The driving couplers 481, 482, 181, and 182 may be connected to a driving unit 7 provided in the main body 1 when the imaging cartridge 400 and the toner cartridge 100 are mounted in the main body 1, and may be driven independently or in connection with the driving unit 7.

Referring to FIG. 16, a controller 6 may be an electric circuit including, for example, at least one central processing unit, and controls the overall operation of the image forming apparatus. The controller 6 may be driven by, for example, software stored in a memory (not shown) or by software provided by a host (not shown). The controller 6 may be connected to a user interface unit (not shown), for example, an input device (not shown), through which a manipulation command of a user is to be input, and an output device (not shown) that displays an operating state of the image forming apparatus. The user interface unit may receive a manipulation command of a user through the input device and transmit an output signal to the output device so as to display, for example, an operating state of the image forming apparatus.

When the imaging cartridge 400 and the toner cartridge 100 are mounted in the main body 1, the first and second contact portions 112 and 412 may be respectively connected to the first and second connection portions 3 and 4. Accordingly, the first and second memory units 110 and 410 may be connected to the controller 6, and the controller 6 may determine whether the toner cartridge 100 and the imaging cartridge 400 are mounted in the main body 1 or not based on whether communication with the first and second memory units 110 and 410 is possible.

The optical sensor 316 of the toner level detecting unit 310-1 (hereinafter referred to as a first optical sensor 316-1) may be connected to the controller 6 via the first contact portion 112 and the second connection portion 4, and the optical sensor 316 of the second toner level detecting unit 310-2 (hereinafter referred to as a second optical sensor 316-2) may be connected to the controller 6 via the second contact portion 412 and the first connection portion 3. Detection signals of the first and second optical sensors 316-1 and 316-316-2 may be respectively transmitted to the controller 6 via the first and second contact portions 112 and 412 and the second and first connection portions 4 and 3, and the toner level of the development chamber 60 may be adjusted based on the detection signals of the first and second optical sensors 316-1 and 316-2.

A structure for detecting a toner level illustrated in FIGS. 8 and 9 may be used in the system structural diagram illustrated in FIG. 16. When a structure according to the embodiment illustrated in FIG. 7 is used as a structure for detecting a toner level, the first and second toner level detecting units 310-1 and 310-2 may be provided in the imaging cartridge 400, and the optical sensors 316-1 and 316-2 of the first and second toner level detecting units 310-1 and 310-2 may be connected to the controller 6 so as to transmit first and second toner levels ADC1 and ADC2 to the controller 6. For example, the optical sensor 316-1 of the first toner level detecting unit 310-1 may be connected to the controller 6 via contact portion 112 and second connection portion 4. For example, the optical sensor 316-2 of the second toner level detecting unit 310-2 may be connected to the controller 6 via contact portion 412 and first connection portion 3, as shown in FIG. 16. For example, the first and second toner levels ADC1 and ADC2 may be calculated by sequentially inputting the detection signals of the first and second optical sensors 316-1 and 316-2 to a noise removing unit (not shown), an amplifier (not shown), and an analog-to-digital converter (not shown).

The first and second toner levels ADC1 and ADC2 indicate the toner level in the development chamber 60. For example, the first and second toner levels ADC1 and ADC2 may be high when a large amount of toner exists in the development chamber 60, and may be low when a small amount of toner exists in the development chamber 60. The first and second toner levels ADC1 and ADC2 may be respectively an average of toner levels that are repeatedly measured a number of times.

Figure 17A:
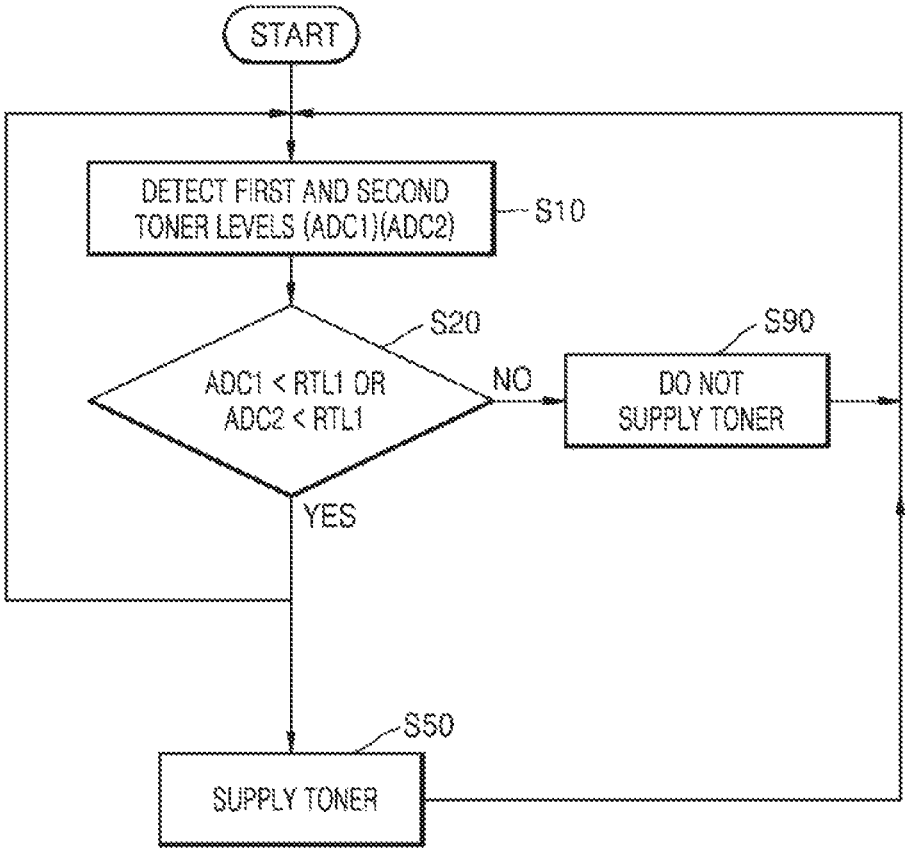
FIG. 17A is a flowchart of a method of adjusting a toner level according to an embodiment.

FIG. 17A is a flowchart of a method of adjusting a toner level according to an embodiment. Hereinafter, a method of controlling a toner level in the development chamber 60 based on the first and second toner levels ADC1 and ADC 2 will be described.

Referring to FIG. 17A, when an operation of the image forming apparatus starts, the toner level in the development chamber 60 may be detected based on detection signals output by the first and second optical sensors 316-1 and 316-2 in operation S10.

Figure 18:
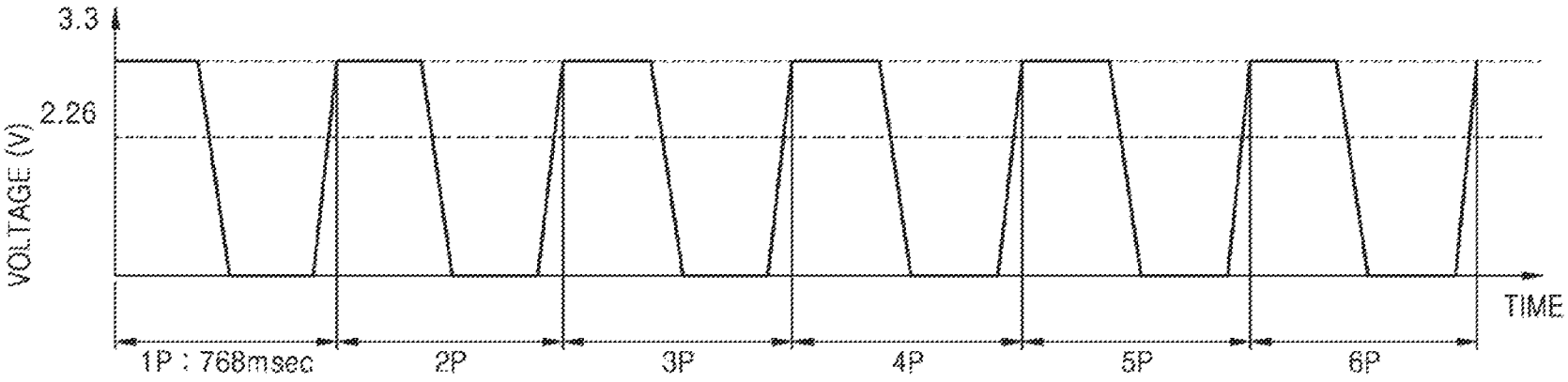
FIG. 18 illustrates a detection signal of first and second optical sensor according to an embodiment.

FIG. 18 illustrates a detection signal output by the first and second optical sensors 316-1 and 316-2 according to an embodiment. As illustrated in FIG. 18, the detection signals output by the first and second optical sensors 316-1 and 316-2 may be, for example, a voltage signal that indicates or represents a toner level. For example, the higher the toner level, the higher a voltage of the detection signals output by the first and second optical sensors 316-1 and 316-2. Signal processing may be performed on the detection signals output by the first and second optical sensors 316-1 and 316-2 through the noise filter, the amplifier, and the analog-to-digital converter described above so as to calculate the first and second toner levels ADC1 and ADC2. For example, when a maximum voltage and a minimum voltage of the detection signals of the first and second optical sensors 316-1 and 316-2 are 3.3 V and 0 V, respectively, toner levels respectively corresponding thereto may be '1024' and '0.' When a voltage of the detection signals of the first and second optical sensors 316-1 and 316-2 is 1V, a corresponding toner level may be, for example, 310.

The first and second toner levels ADC1 and ADC2 may be respectively an average of multiple measurement values. For example, measurements may be performed at an interval of about 10 msec. The wiper 317 may perform a cleaning operation of wiping the light guide member (the light exit surface 311*b* and the light incident surface 312*b*) about every 768 msec, and about 76 measurements may be performed during one cleaning operation time of the wiper 317 (driving period). Accordingly, the about 76 measurements may be referred to as one measurement period (1P). Pollution of the light exit surface 311*b* and the light incident surface 312*b* may affect the first and second toner levels ADC1 and ADC2. Pollution of the light exit surface 311*b* and the light incident surface 312*b* may not be removed just by one time cleaning operation by using the wiper 317, and in this case, the first and second toner levels ADC1 and ADC2 may not indicate the true value of the toner level of the development chamber 60. Accordingly, measurements may have to be performed for at least m measurement periods mP (where m is a positive integer greater than 1) or more. According to one or more embodiments of the disclosure, respective averages of toner levels measured during a plurality of measurement periods (e.g., six measurement periods 6P) may be used as the first and second toner levels ADC1 and ADC2. By using the respective averages of multiple measurements as the first and second toner levels ADC1 and ADC2, the reliability of detecting the toner level may be improved.

Next, whether the toner level in the development chamber 60 is normal is determined based on the first and second toner levels ADC1 and ADC2 in operation S20. If any one of the one of the first and second toner levels ADC1 and ADC2 is smaller than a first reference toner level RTL1, the controller 6 may control the driving unit 7 such that toner is supplied to the development chamber 60 in operation S50. Alternatively, the controller 6 may control the driving unit 7 such that toner is supplied to the development chamber 60 in operation S50 only if both the first and second toner levels ADC1 and ADC2 are smaller than the first reference toner level RTL1. For example, when any one of the first and second toner levels ADC1 and ADC2 is greater than the first reference level RTL1, it may be determined in operation S90 that the toner level of the development chamber 60 is normal and toner is not supplied. Alternatively, the controller 6 may control the driving unit 7 such that toner is not supplied to the development chamber 60 in operation S90 only if both the first and second toner levels ADC1 and ADC2 are greater than the first reference toner level RTL1. When supplying toner to the development chamber 60, toner may be continuously supplied until at least one of the first and second toner levels ADC1 and ADC2 is greater than the first reference toner level RTL1. Alternatively, the controller 6 may control the driving unit 7 to supply toner in operation S50 until both the first and second toner levels ADC1 and ADC2 are greater than the first reference toner level RTL1.

Figure 19:
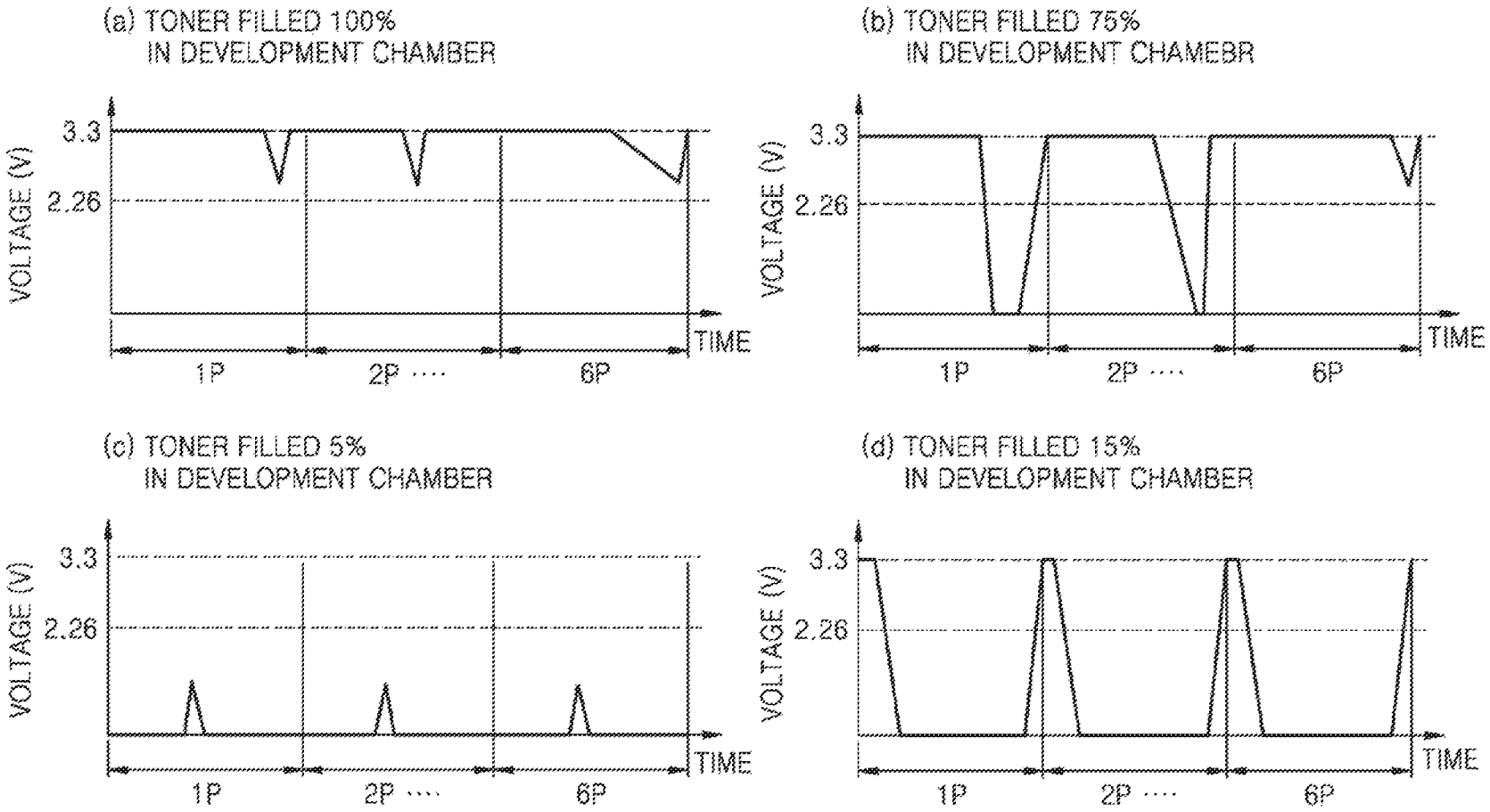
FIG. 19 illustrates a detection signal of first and second optical sensors according to embodiments, according to a charging amount of toner in a development chamber.

The first reference toner level RTL1 may be experimentally determined. FIG. 19 illustrates a detection signal output by the first and second optical sensors 316-1 and 316-2 according to one or more embodiments of the disclosure, the detection signal indicating or representing an amount of toner in the development chamber 60. Referring to FIG. 19, when the amount of toner in the development chamber 60 increases, a voltage of the detection signal is closer to about 3.3 V, and when the amount of toner decreases, the voltage is closer to about 0 V. An average voltage also increases as the amount of toner in the development chamber 60 increases, and decreases when the amount of toner is the development chamber 60 decreases. Table 3 shows real measurement values of the toner level. In each case, the measured values of the first and second toner levels ADC1 and ADC2 are the smallest when the wiper 317 blocks the light path.

TABLE 3

| | ADC1 | | | ADC2 | | |
|---|---|---|---|---|---|---|
| Toner amount | average | minimum | maximum | average | minimum | maximum |
| 25 g | 68 | 22 | 705 | 59 | 18 | 658 |
| 80 g | 708 | 57 | 947 | 692 | 66 | 921 |

Figure 20:
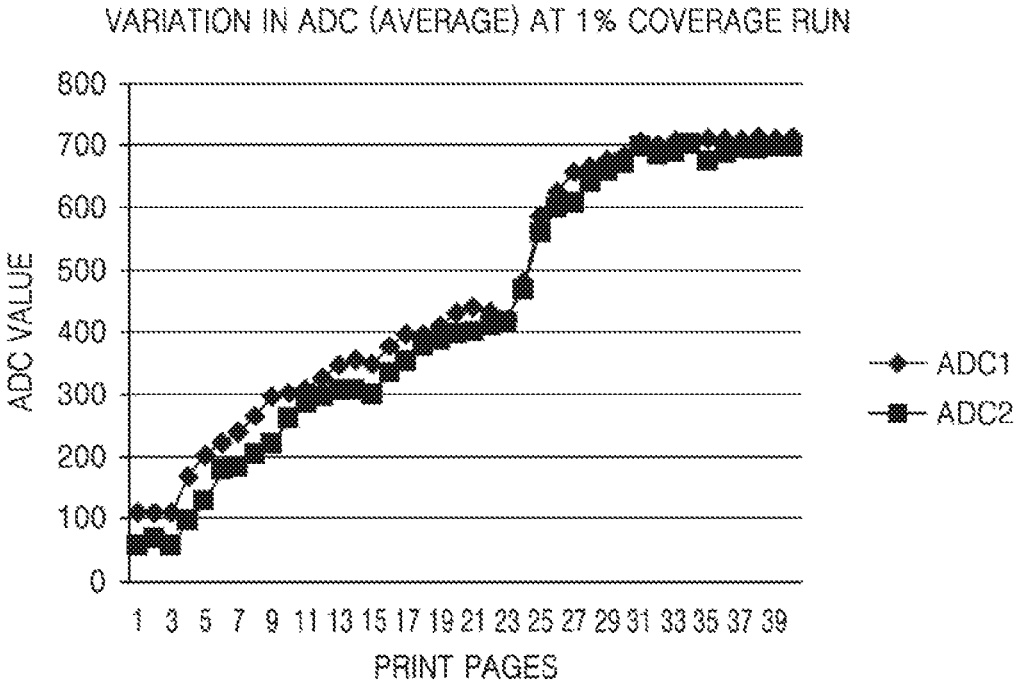
FIG. 20 is a graph showing a variation in first and second toner levels when 1% coverage images are continuously output.
Figure 21:
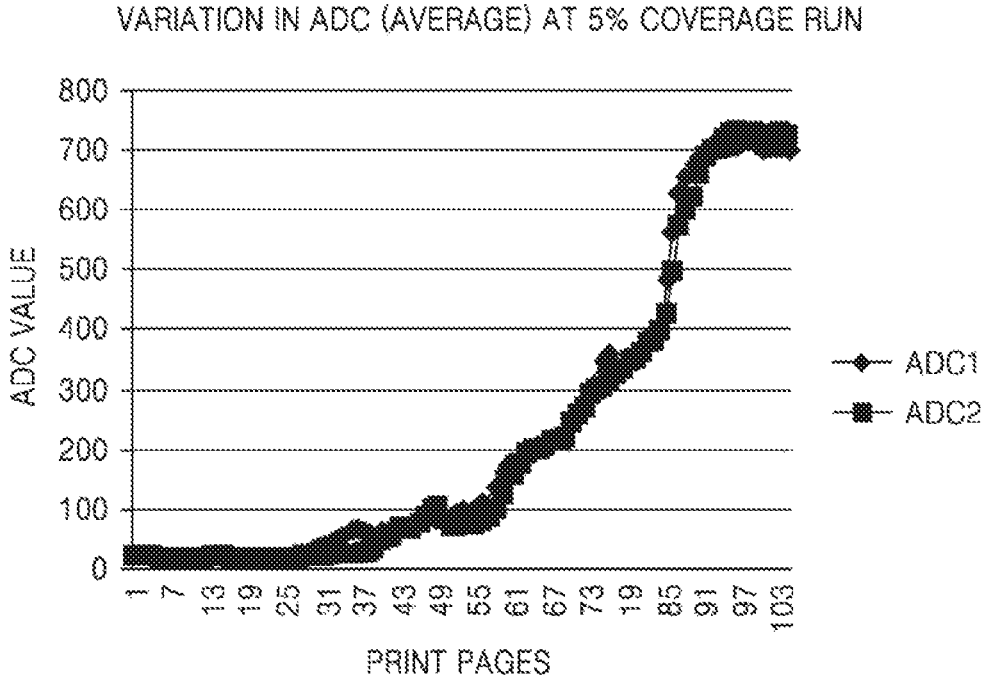
FIG. 21 is a graph showing a variation in first and second toner levels when 5% coverage images are continuously output.

For example, the first reference toner level RTL1 may be '600'. FIGS. 20 and 21 show a variation in the toner level in the development chamber 60, that is, a variation in the first and second toner levels ADC1 and ADC2 while coverage of a print image varies according to the above-described method of controlling a toner level.

FIG. 20 is a graph showing a variation in the first and second toner levels ADC1 and ADC2 when a 1% coverage image is continuously output. Referring to FIG. 20, at an initial state where image output is started, it is determined that a toner level is low and thus toner is continuously supplied to the development chamber 60. Accordingly, the first and second toner levels ADC1 and ADC2 are simultaneously increased. When printing an image with a 1% coverage, a toner consumption amount is small, and thus, after printing about 30 sheets, both the first and second toner levels ADC1 and ADC2 reach a saturation value and do not increase anymore. Accordingly, it may be confirmed that toner supply is stabilized in this state.

FIG. 21 is a graph showing a variation in the first and second toner levels ADC1 and ADC2 when a 5% coverage image is continuously output. Referring to FIG. 21, at an initial state where image output is started, it is determined that a toner level is low and thus toner is continuously supplied to the development chamber 60. Accordingly, the first and second toner levels ADC1 and ADC2 are simultaneously increased. When printing an image with a 5% coverage, a toner consumption amount is relatively large, and thus, after printing about 90 sheets, both the first and second toner levels ADC1 and ADC2 reach a saturation value and do not increase anymore. Accordingly, it may be confirmed that toner supply is stabilized in this state.

The first and second toner levels ADC1 and ADC2 are averages of multiple measurements, and thus, they generally properly indicate the toner level in the development chamber 60. However, due to defects such as defects of the optical sensors 316-1 and 316-2 or cleaning defects of the light guide members, the first and second toner levels ADC1 and ADC2 may not properly indicate the toner level in the development chamber 60. If the toner level is controlled based on incorrect first and second toner levels ADC1 and ADC2, the toner level in the development chamber 60 may be excessively high, and thus, a toner pressure increases. Also, the toner level may be determined to be normal even though the toner level in the development chamber 60 is low and printing may be continued without supplying toner, which may cause a decrease in image density.

Figure 17B:
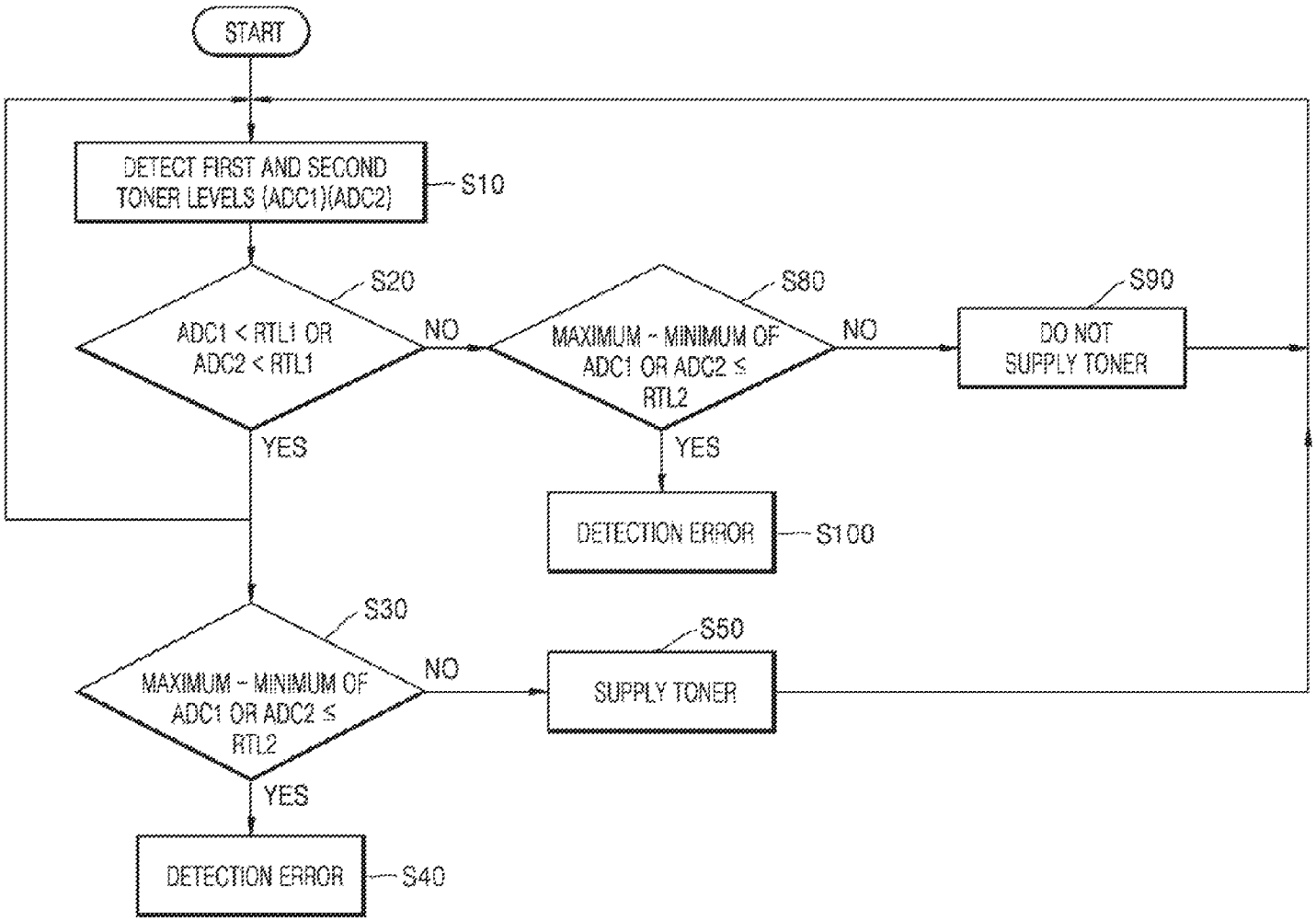
FIG. 17B is a flowchart of a method of adjusting a toner level according to an embodiment.

FIG. 17B is a flowchart of a method of adjusting a toner level according to an embodiment. Referring to FIG. 17B, before proceeding to operation S50 of supplying toner or operation S90 of not supplying toner, operation S30 or S80 of determining whether a detection error occurs may be selectively performed. A detection error may be caused, for example, by defects of the optical sensors 316-1 and 316-2, a short circuit of circuits operating in conjunction with the optical sensors 316-1 and 316-2, or cleaning defects of the light guide member. Whether a detection error occurred or not may be determined based on whether any one of differences between a maximum and a minimum of each of the first and second toner levels ADC1 and ADC2 is smaller than the second reference toner level RTL2. If a state where any one of the differences between a maximum and a minimum of each of the first and second toner levels ADC1 and ADC2 is smaller than the second reference toner level RTL2 continues a predetermined number of times or more, the controller 6 may determine that a detection error occurred in operation S40 and S100 and stops the operation of the image forming apparatus. For example, if a state where any one of the differences between a maximum and a minimum of each of the first and second toner levels ADC1 and ADC2 is smaller than the second reference toner level RTL2 continues for n measurement periods (nP), the controller 6 may determine that a detection error occurred. In this case, n may be greater than m. For example, n may be 25 or greater.

The controller 6 may display a toner level detection error by using, for example, an output device. For example, the controller 6 may control the output device such that a detection error message with regard to a toner level is displayed on a display or a lamp is turned on or flickers, or a sound output may be utilized to indicate the error.

When a detection error is detected, the controller 6 may ignore a detection signal of a corresponding toner level detecting unit to which the error pertains (for example, the first toner level detecting unit 310-1). That is, a toner level may be adjusted based on a detection signal of the second toner level detecting unit 310-2 in which no detection error occurred. As described above, by including two toner level detecting units 310-1 and 310-2, even if one of them is out of order, the toner level may be adjusted by using the other one. In this case, a printing operation may be performed until a corresponding cartridge between the toner cartridge 100 and the imaging cartridge 400 is replaced, and thus, user convenience may be improved.

The second reference toner level RTL2 may be determined by examining a variation in the first and second toner levels ADC1 and ADC2 when a detection error occurs due to various factors. Table 4 below shows a result of measuring a toner level ADC when a detection error occurs due to several factors.

TABLE 4

| | ADC | | | (maximum − minimum)/ maximum[%] | maximum − minimum |
|---|---|---|---|---|---|
| | average | minimum | maximum | | |
| 1 fully filled with toner | 995 | 894 | 1004 | 10.96 | 110 |
| 2 Short circuit of circuit | 1022 | 1019 | 1023 | 0.39 | 4 |
| 3 Cleaning defect of light guide member | 1001 | 991 | 1008 | 0.39 | 17 |

Referring to Table 4 above, when a detection error occurred, an average, a maximum, and a minimum of toner levels ADC are very high, and a difference between the maximum and the minimum levels is very small. The difference is smaller than a difference between a maximum and a minimum of the toner level ADC when toner is filled fully. Accordingly, the difference between the maximum and the minimum levels when a detection error occurred may be clearly distinguished from a difference between the maximum and the minimum levels in a normal state. For example, the second reference toner level RTL2 may be set to '20'.

When a mechanical apparatus that supplies toner to the development chamber 60 is out of order, that is, when the toner cartridge 100 itself is out of order, for example, when the driving unit 7 is out of order or a gear that connects the driving couplers 181 and 182 and the first and second toner transporting members 103 and 104 is damaged, toner may not be supplied to the development chamber 60 even when the controller 6 controls the driving unit 7 to supply toner, and thus, a supply error where the first and second toner levels ADC1 and ADC2 do not rise occurs. The supply error may also occur when the toner cartridge 100 is mounted in the main body 1 without removing a seal (not shown) that blocks the toner outlet 107. The supply error may also occur when most of the toner contained in the toner cartridge 100 is consumed.

Figure 17C:
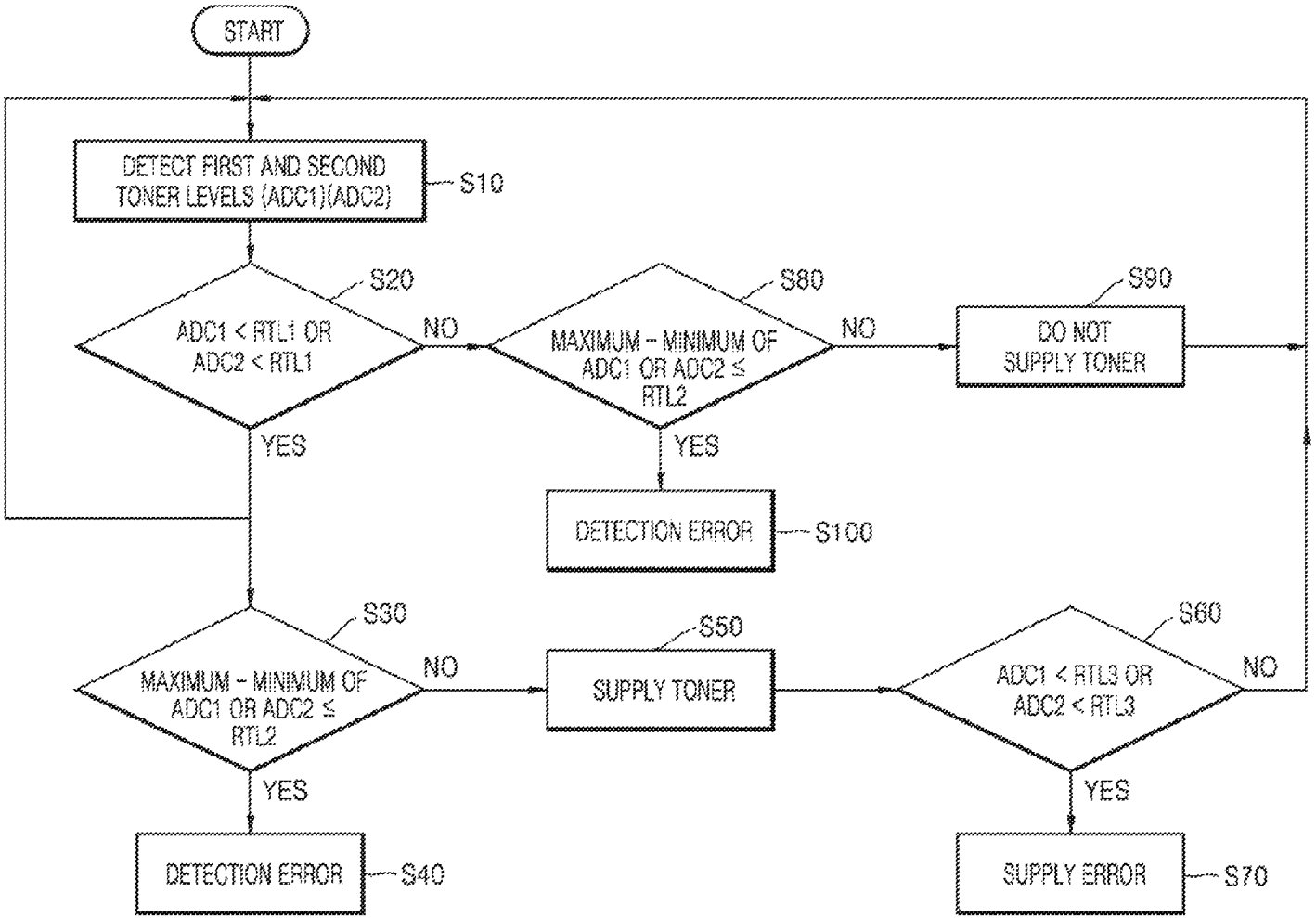
FIG. 17C is a flowchart of a method of adjusting a toner level according to an embodiment.

FIG. 17C is a flowchart of a method of adjusting a toner level according to an embodiment. Referring to FIG. 17C, when any one of the first and second ADC1 and ADC2 does not rise to a third reference toner level RTL3 or higher in operation S60, it may be determined in operation S70 that a toner supply error occurred. The third reference toner level RTL3 may be higher than the second reference toner level RTL2 and smaller than the first reference toner level RTL1. For example, the third reference toner level RTL3 may be set to '200'. Alternatively, the controller 6 may determine a toner supply error has occurred at operation S60 only if both the first and second toner levels ADC1 and ADC2 are less than the third reference toner level RTL3.

If it is determined that the supply error occurred, the controller 6 may control the output device to output a message that the toner supply error occurred. The message may be output via a display, via a light or lamp, and/or via sound, etc. Also, the controller 6 may control the output device to output a message for addressing the toner supply error. For example, if a residual amount of toner in the toner cartridge 100 is 100%, that is, if a new toner cartridge 100 is mounted in the main body 1, the message "remove seal or shake toner cartridge" may be output to indicate the toner supply error. If a residual amount of toner in the toner cartridge 100 is from about 99% to about 31%, the message "shake cartridge or call service team if problem persists" may be output to indicate the toner supply error. If a residual amount of toner of the toner cartridge 100 is about 11% to about 30%, the message "shake cartridge or replace toner cartridge if problem persists" may be output to indicate the toner supply error. If a residual amount of toner in the toner cartridge 100 is about 10% or lower, the message "replace toner cartridge" may be output to indicate the toner supply error. The residual amount of toner in the toner cartridge 100 may be determined based on, for example, an accumulated print dot number, accumulated printed pages, or an accumulated operating time of a motor for a toner supply of the driving unit 7.

According to the above-described structure, an error regarding adjustment of the toner level due to a detection error or a toner supply error may be prevented.

While two toner level detecting units 310 have been described in the above embodiments, the embodiments of the disclosure are not limited thereto and three or more toner level detecting units 310 may be used. In this case, if a toner level of any one of a plurality of toner level detecting units 310 is smaller than the first reference toner level RTL1, the controller 6 may control the driving unit 7 such that toner is supplied to the development chamber 60. Also, if a difference between a maximum and a minimum of each of ADCs in any one of the plurality of toner level detecting units 310 is smaller than the second reference toner level RTL2 for a predetermined measurement period, the controller 6 may determine that a detection error occurred. Also, if a toner level in any one of the plurality of toner level detecting units 310 is smaller than the third reference toner level RTL3, the controller 6 may determine that a toner supply error occurred.

While the process cartridge 2 having the first structure has been described in the above embodiments, the embodiments of the disclosure are not limited thereto and the process cartridge 2 according to the embodiments of the disclosure may also have the second, third, or fourth structure.

It should be understood that the exemplary embodiments described therein should be considered in a descriptive sense only and not for purposes of limitation. Descriptions of features or aspects within each embodiment should typically be considered as available for other similar features or aspects in other embodiments.

The apparatuses and methods according to the above-described example embodiments may use one or more processors. For example, a processing device may be implemented using one or more general-purpose or special purpose computers, and may include, for example, one or more of a processor, a controller and an arithmetic logic unit, a central processing unit (CPU), a graphics processing unit (GPU), a digital signal processor (DSP), an image processor, a microcomputer, a field programmable array, a programmable logic unit, an application-specific integrated circuit (ASIC), a microprocessor or any other device capable of responding to and executing instructions in a defined manner.

The apparatuses and methods according to the above-described example embodiments may use one or more storage devices or memories. For example, a storage may be embodied as a storage medium, such as a nonvolatile memory device, such as a Read Only Memory (ROM), Programmable Read Only Memory (PROM), Erasable Programmable Read Only Memory (EPROM), and flash memory, a USB drive, a volatile memory device such as a Random Access Memory (RAM), a hard disk, floppy disks, a blue-ray disk, or optical media such as CD ROM discs and DVDs, or combinations thereof. However, examples of the storage are not limited to the above description, and the storage may be realized by other various devices and structures as would be understood by those skilled in the art.

The terms "module", and "unit," as used herein, may refer to, but are not limited to, a software or hardware component or device, such as a Field Programmable Gate Array (FPGA) or Application Specific Integrated Circuit (ASIC), which performs certain tasks. A module or unit may be configured to reside on an addressable storage medium and configured to execute on one or more processors. Thus, a module or unit may include, by way of example, components, such as software components, object-oriented software components, class components and task components, processes, functions, attributes, procedures, subroutines, segments of program code, drivers, firmware, microcode, circuitry, data, databases, data structures, tables, arrays, and variables. The functionality provided for in the components and modules/units may be combined into fewer components and modules/units or further separated into additional components and modules. Each block of the flowchart illustrations may represent a unit, module, segment, or portion of code, which comprises one or more executable instructions for implementing the specified logical function(s). It should also be noted that in some alternative implementations, the functions noted in the blocks may occur out of order. For example, two blocks shown in succession may in fact be executed substantially concurrently (simultaneously) or the blocks may sometimes be executed in the reverse order, depending upon the functionality involved.

Aspects of the above-described example embodiments may be recorded in non-transitory computer-readable media including program instructions to implement various operations embodied by a computer. The media may also include, alone or in combination with the program instructions, data files, data structures, and the like. Examples of non-transitory computer-readable media include magnetic media such as hard disks, floppy disks, and magnetic tape; optical media such as CD ROM disks, Blue-Ray disks, and DVDs; magneto-optical media such as optical discs; and other hardware devices that are specially configured to store and perform program instructions, such as semiconductor memory, read-only memory (ROM), random access memory (RAM), flash memory, USB memory, and the like. Examples of program instructions include both machine code, such as produced by a compiler, and files containing higher level code that may be executed by the computer using an interpreter. The program instructions may be executed by one or more processors. The described hardware devices may be configured to act as one or more software modules in order to perform the operations of the above-described embodiments, or vice versa. In addition, a non-transitory computer-readable storage medium may be distributed among computer systems connected through a network and computer-readable codes or program instructions may be stored and executed in a decentralized manner. In addition, the non-transitory computer-readable storage media may also be embodied in at least one application specific integrated circuit (ASIC) or Field Programmable Gate Array (FPGA)

While one or more embodiments of the disclosure have been described with reference to the figures, it will be understood by those of ordinary skill in the art that various changes in form and details may be made therein without departing from the spirit and scope of the disclosure as defined by the following claims.

What is claimed is:

1. A toner cartridge that is detachable from an imaging cartridge disposed in a main body of an image forming apparatus, the toner cartridge comprising:

a toner container to contain toner to be supplied to a development chamber disposed in the imaging cartridge; and an optical sensor comprising a light emitter to irradiate light into the development chamber and a light receiver to receive light that is emitted out of the development chamber after passing through the development chamber, and to detect a toner level in the development chamber.

2. The toner cartridge of claim 1, further comprising:

a memory that is connectable to a connection portion provided in the main body when the toner cartridge is mounted in the main body to transmit to the main body the toner level detected by using the optical sensor.

3. The toner cartridge of claim 2, wherein the memory comprises a contact portion via which the memory is connectable to the main body, wherein the contact portion is movable to a first position inside the toner cartridge and a second position outside the toner cartridge so that the contact portion is connectable to the connection portion.

4. The toner cartridge of claim 3, further comprising a protection member that is moveable to a retreat position in the cartridge as the contact portion is moved to the first position and is moveable to a protruding position outside the cartridge to be insertable into an insertion portion in the main body as the contact portion is moved to the second position.

5. The toner cartridge of claim 4, wherein the protection member is configured to be inserted into the insertion portion before the contact portion is connected to the connection portion to align the contact portion and the connection portion.

6. The toner cartridge of claim 4, further comprising a moving member on which the contact portion is mounted, wherein the moving member is moved to the first or second position, and wherein the protection member is integrally formed with the moving member.

7. The toner cartridge of claim 1, further comprising a waste toner container to contain waste toner removed from a photoreceptor provided in the main body, and wherein the waste toner container is disposed below the toner container in a gravitational direction.

8. The toner cartridge of claim 1, further comprising a toner discharger comprising a toner outlet at one end of the toner discharger, and wherein a first toner supply member to carry toner to the toner discharger is disposed in the toner container.

9. The toner cartridge of claim 8, wherein a second toner supply member to carry toner to the toner discharger is disposed in the toner discharger.

10. The toner cartridge of claim 1, further comprising a toner discharging unit configured to supply the toner contained in the toner container to the development chamber via a toner outlet disposed at an end portion of the toner discharging unit.

* * * * *